US012528620B2

(12) United States Patent
Yamada

(10) Patent No.: US 12,528,620 B2
(45) Date of Patent: Jan. 20, 2026

(54) PACKAGING MATERIAL AND PACKING MATERIAL

(71) Applicant: FUJIFILM Business Innovation Corp., Tokyo (JP)

(72) Inventor: Keigo Yamada, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 17 days.

(21) Appl. No.: 18/636,246

(22) Filed: Apr. 15, 2024

(65) Prior Publication Data

US 2025/0136327 A1 May 1, 2025

(30) Foreign Application Priority Data

Oct. 27, 2023 (JP) ..... 2023-184444

(51) Int. Cl.
*B65D 27/22* (2006.01)
*B65D 77/04* (2006.01)
*B65D 81/03* (2006.01)

(52) U.S. Cl.
CPC ..... *B65D 27/22* (2013.01); *B65D 77/042* (2013.01); *B65D 81/03* (2013.01)

(58) Field of Classification Search
CPC ..... B65D 27/22; B65D 77/042; B65D 81/03; B65D 81/05; B65D 75/30; B65D 5/0209; B65D 81/07; B65D 3/00; B65D 5/5007
USPC .... 229/68.1, 103.2; 206/583, 521, 594, 451, 206/585, 586
See application file for complete search history.

(56) References Cited

U.S. PATENT DOCUMENTS 2,714,981 A * 8/1955 Leavens ..... B65D 5/5016 206/583
3,221,973 A * 12/1965 Kalbrener ..... B65D 5/5033 206/600

(Continued)

FOREIGN PATENT DOCUMENTS

JP H10119957 5/1998
JP 3831991 10/2006

(Continued)

OTHER PUBLICATIONS

"Search Report of Europe Counterpart Application", issued on Sep. 19, 2024, p. 1-p. 7.

*Primary Examiner* — Christopher R Demeree
(74) *Attorney, Agent, or Firm* — JCIPRNET

(57) ABSTRACT

A packaging material includes a first surface part that is adjacent to one side of a boundary line and has a bottom plate on which an object to be packaged is placed, and a second surface part that is adjacent to the other side of the boundary line and has a top plate that holds and wraps the object to be packaged with the bottom plate in a state of being folded along the boundary line, the boundary line being interposed between the first surface part and the second surface part, in which the bottom plate and the top plate are rectangular regions where one corner of the bottom plate and one corner of the top plate are in contact with each other at the boundary line, and portions of the first surface part and the second surface part, which are located outside four sides of a rectangular shape of the bottom plate and the top plate, are folding portions that are foldable at the four sides.

20 Claims, 21 Drawing Sheets

(56) References Cited

U.S. PATENT DOCUMENTS

| | | | | | |
|---|---|---|---|---|---|
| 4,606,460 | A * | 8/1986 | Luray | B65D 81/07 | 206/583 |
| 4,865,200 | A * | 9/1989 | Sullivan | B65D 5/5035 | 206/451 |
| 6,158,589 | A | 12/2000 | Smith et al. | | |
| 6,666,333 | B2 * | 12/2003 | Auclair | B65D 5/5007 | 206/521 |
| 2012/0298547 | A1 | 11/2012 | Collier | | |

FOREIGN PATENT DOCUMENTS

| | | |
|---|---|---|
| JP | 2007039052 | 2/2007 |
| JP | 2010241497 | 10/2010 |
| JP | 5417955 | 2/2014 |
| JP | 7034469 | 3/2022 |

* cited by examiner

PACKAGING MATERIAL AND PACKING MATERIAL

CROSS-REFERENCE TO RELATED APPLICATIONS

This application is based on and claims priority under 35 USC 119 from Japanese Patent Application No. 2023-184444 filed Oct. 27, 2023.

BACKGROUND

(i) Technical Field

The present invention relates to a packaging material and a packing material.

(ii) Related Art

JP3831991B (claims 1 and 2 and FIGS. 1 to 7) discloses a packaging box that is formed by folding two blanks formed by punching out cardboard or corrugated cardboard and combining the blanks into a box formed into a square tubular shape with a gluing flap.

JP2007-39052A (claims 1 and 2 and FIGS. 1 to 23) discloses a cross-shaped flat plate buffer packaging tool in which both wing end parts in a longitudinal direction and a tongue piece provided at a middle lower part of an elastic thin film are adhered to a top surface of a base plate having a predetermined shape, on a back surface of the elastic thin film, through a straight punched hole.

In addition, JP2007-39052A (claims 1 and 2 and FIGS. 1 to 23) also discloses a cross-shaped flat plate buffer packaging tool in which a part of an upper end of a top surface of a base plate having a predetermined shape is folded in half, and both wing end parts in a longitudinal direction and a tongue piece provided at a middle lower part of an elastic thin film having a rectangular shape are adhered to the top surface of the base plate, on a back surface of the elastic thin film, through a straight punched hole.

Furthermore, JP2007-39052A (claims 1 and 2 and FIGS. 1 to 23) discloses that the two flat plate buffer packaging tools accommodate an object to be packaged in a bag consisting of a plate material that can have a buffering structure and one elastic thin film whose three portions, that is, a part of an end part in a width direction and both end parts in the longitudinal direction are bonded to the plate material.

JP5417955B (claim 1 and FIGS. 1 to 3) discloses a paper tray that is formed by assembling one blank and that has a rectangular bottom plate and side plates formed to stand up on four sides of the bottom plate.

In addition, JP5417955B (claim 1 and FIGS. 1 to 3) also discloses that the paper tray includes a standing plate connected to a base plate parallel to the bottom plate from at least one side plate toward an inside of the tray via a folding line, and a fastening plate that is connected to at least one side of the side plate and the bottom plate to cover a part of a region surrounded by the side plate, the base plate, and the standing plate, and the tray, and a part of a region outside the region.

SUMMARY

Aspects of non-limiting embodiments of the present disclosure relate to a packaging material with which an object to be packaged can be packaged in a state where a tension is applied by partial folding, and a packing material using the same.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a packaging material including a first surface part that is adjacent to one side of a boundary line and has a bottom plate on which an object to be packaged is placed, and a second surface part that is adjacent to the other side of the boundary line and has a top plate that holds and wraps the object to be packaged with the bottom plate in a state of being folded along the boundary line, the boundary line being interposed between the first surface part and the second surface part, in which the bottom plate and the top plate are rectangular regions where one corner of the bottom plate and one corner of the top plate are in contact with each other at the boundary line, and portions of the first surface part and the second surface part, which are located outside four sides of a rectangular shape of the bottom plate and the top plate, are folding portions that are foldable at the four sides.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments for carrying out the present invention will be described.

Exemplary Embodiment 1

Figure 1:
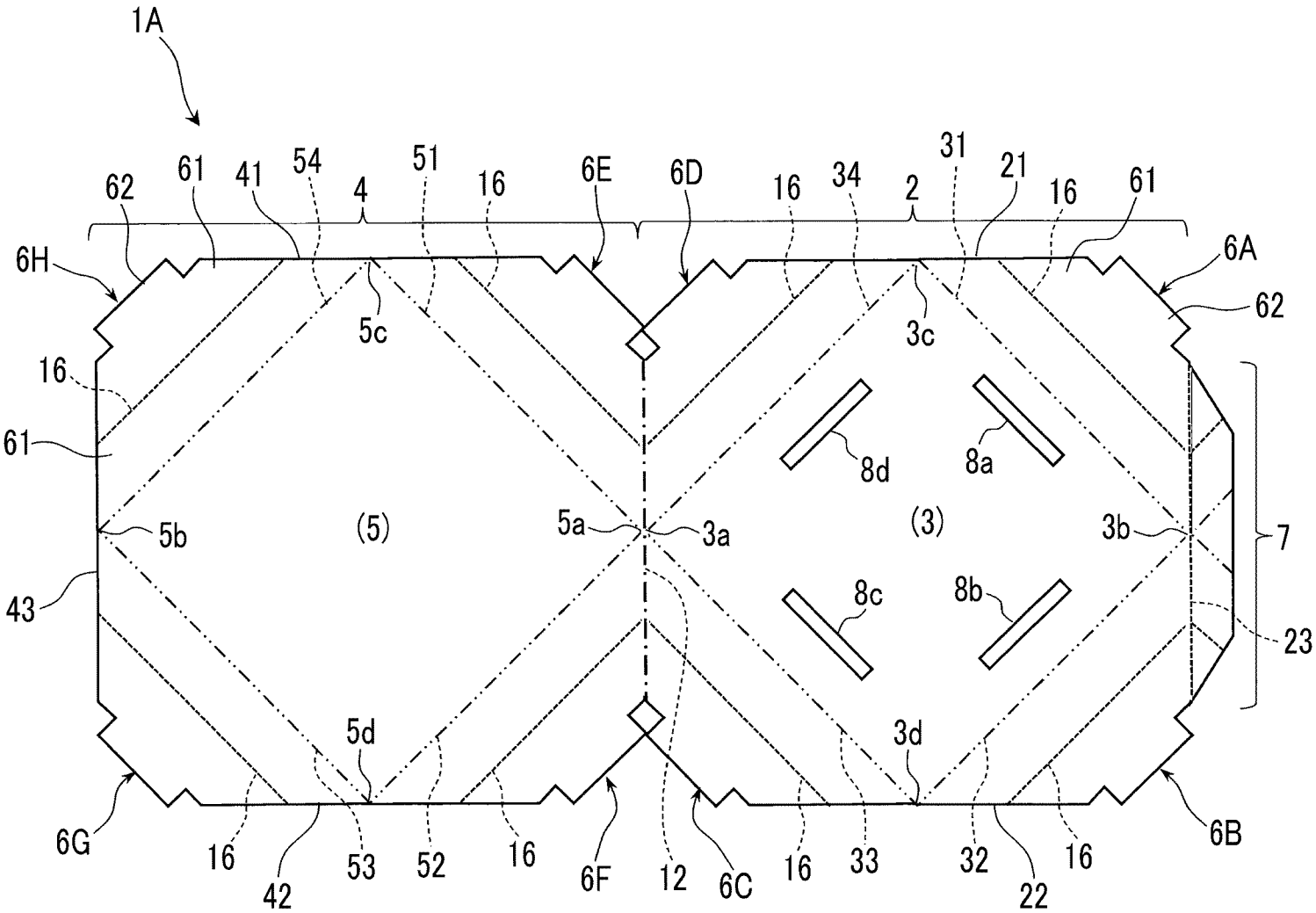
FIG. 1 is a developed view of a packaging material according to Exemplary Embodiment 1.

FIG. 1 is a developed view of a packaging material 1A according to Exemplary Embodiment 1 of the present invention.

In the present specification and the drawings, the same reference numerals are given to substantially the same components. In addition, in the present specification, duplicate description of the same components is omitted.

Configuration of Packaging Material

As shown in FIG. 1, a packaging material 1A includes a first surface part 2 having a bottom plate 3 and a second surface part 4 having a top plate 5.

The first surface part 2 and the second surface part 4 are connected so as to exist on both sides of a boundary line 12. The boundary line 12 is a straight line, and is configured as a portion that triggers folding.

Figure 4A:
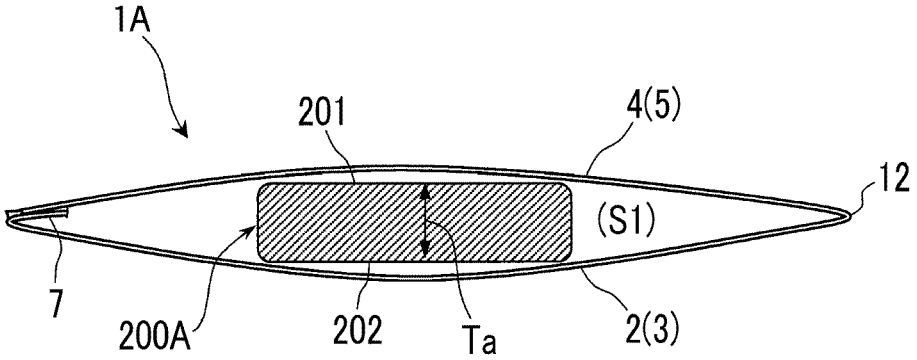
FIG. 4A is a schematic cross-sectional view of a state in which an object to be packaged is accommodated in the accommodation space of the packaging material of FIGS. 3A and 3B.
Figure 4B:
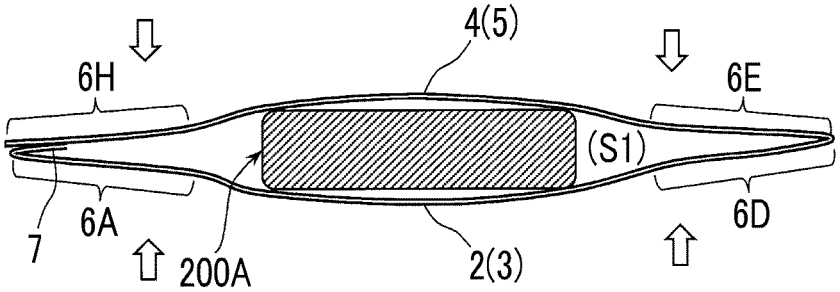
FIG. 4B is a schematic cross-sectional view of a state in which a part of the packaging material of FIG. 4A is pressed to be narrower.
Figure 7A:
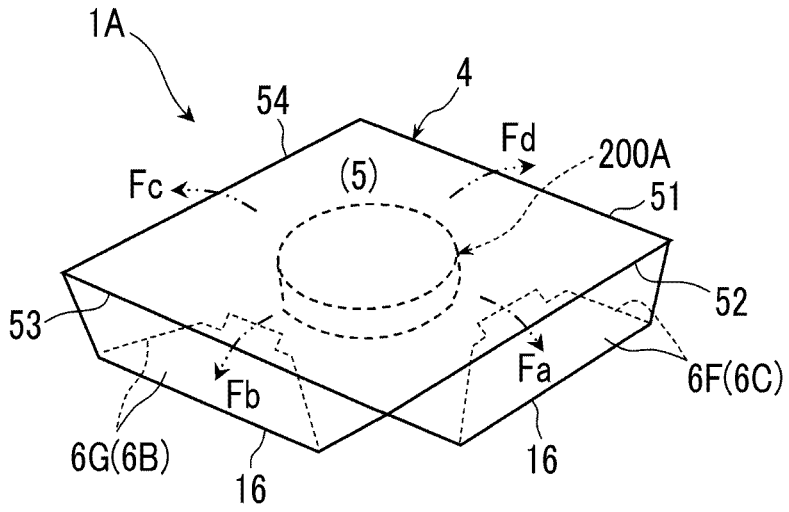
FIG. 7A is a schematic perspective view of a state in which the object to be packaged of the packaging material is packaged.
Figure 7B:
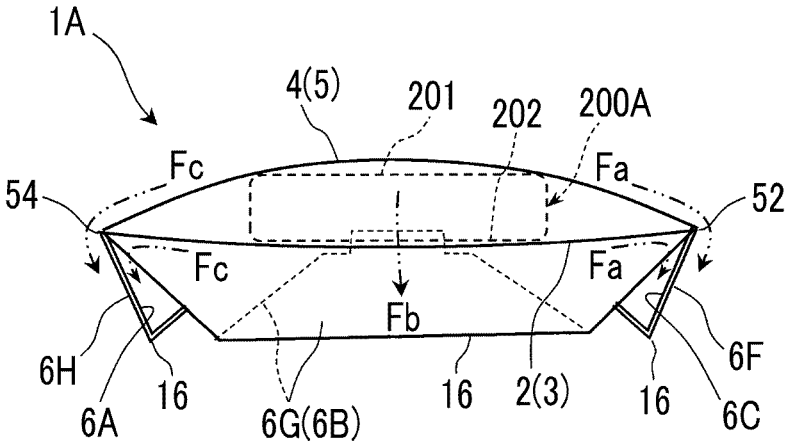
FIG. 7B is a schematic view showing a state in which the packaging material of FIG. 7A is viewed from a side.

As shown in FIGS. 4A and 4B and FIG. 7B, the packaging material 1A is used to package an object to be packaged 200A in a state of being interposed between the bottom plate 3 and the top plate 5.

The first surface part 2 is a surface portion adjacent to one side of the boundary line 12.

The bottom plate 3 is a rectangular region of the first surface part 2 that is divided so as to place the object to be packaged 200A. The rectangle is a square or a rhombus. The bottom plate 3 in Exemplary Embodiment 1 is a square region.

The second surface part 4 is a surface portion adjacent to the other side of the boundary line 12.

The top plate 5 is a rectangular region that is divided so as to hold and wrap the object to be packaged 200A with the bottom plate 3 in a case where the second surface part 4 is folded along the boundary line 12 (see FIG. 4A). The top plate 5 in Exemplary Embodiment 1 is a square region.

As shown in FIG. 1, the bottom plate 3 and the top plate 5 are configured as regions where one corner 3*a* of the bottom plate 3 and one corner 5*a* of the top plate 5 are in contact with each other at the boundary line 12. The corner may be understood as one of four corners of a rectangular region.

The bottom plate 3 and the top plate 5 are formed to have the same dimensions. In addition, the dimensions of the bottom plate 3 and the top plate 5 are set to, for example, dimensions adapted to a size of the object to be packaged 200A to be packaged, or dimensions adapted to an internal size of a box 9 in a case where the packaging material 1A is accommodated in the box 9 and used as a packing material 10 as described below.

In the bottom plate 3, among four corners 3*a*, 3*b*, 3*c*, and 3*d*, two corners 3*c* and 3*d*, which are diagonal to each other, other than the one corner 3*a* are in contact with two sides 21 and 22 of the first surface part 2 orthogonal to the boundary line 12, respectively. In addition, the one remaining corner 3*b* of the bottom plate 3 is in contact with one side 23 of the first surface part 2 parallel to the boundary line 12. The one remaining corner 3*b* is in a diagonal positional relationship with the one corner 3*a*.

In the top plate 5, among four corners 5*a*, 5*b*, 5*c*, and 5*d*, two corners 5*c* and 5*d*, which are diagonal to each other, other than the one corner 5*a* are in contact with two sides 41 and 42 of the second surface part 4 orthogonal to the boundary line 12, respectively. In addition, the one remaining corner 5*b* of the top plate 5 is in contact with one side 43 of the second surface part 4 parallel to the boundary line 12. The one remaining corner 5*b* is in a diagonal positional relationship with the one corner 5*a*.

In addition, the first surface part 2 is configured such that portions of the bottom plate 3, which are outside the four sides 31, 32, 33, and 34, are folding portions 6A, 6B, 6C, and 6D that are foldable at the four sides, respectively.

The folding portion 6A is a portion that is foldable at one side 31 of the bottom plate 3. The folding portion 6B is a portion that is foldable at one side 32 of the bottom plate 3. The folding portion 6C is a portion that is foldable at one side 33 of the bottom plate 3. The folding portion 6D is a portion that is foldable at one side 34 of the bottom plate 3.

Further, the second surface part 4 is configured such that portions of the top plate 5, which are outside the four sides 51, 52, 53, and 54, are folding portions 6E, 6F, 6G, and 6H that are foldable at the four sides, respectively.

The folding portion 6E is a portion that is foldable at one side 51 of the top plate 5. The folding portion 6F is a portion that is foldable at one side 52 of the top plate 5. The folding portion 6G is a portion that is foldable at one side 53 of the top plate 5. The folding portion 6H is a portion that is foldable at one side 54 of the top plate 5.

Here, the four sides 31, 32, 33, and 34 of the bottom plate 3 are configured as folding lines in order to facilitate the folding of the folding portions 6A, 6B, 6C, and 6D.

In addition, the four sides 51, 52, 53, and 54 of the top plate 5 are configured as folding lines in order to facilitate the folding of the folding portions 6E, 6F, 6G, and 6H.

The folding lines of the four sides of the bottom plate 3 and the top plate 5 are formed, for example, by making notches or perforations of a predetermined depth on one surface of the surface material for manufacturing the packaging material 1A.

As represented by the folding portion 6A in FIG. 1, the folding portions 6A, 6B, 6C, and 6D have a trapezoidal body portion 61 whose bottom side (lower base) is one of the four sides 31, 32, 33, and 34 of the bottom plate 3. In addition, as shown in FIG. 1, the folding portions 6A, 6B, 6C, and 6D are provided with an insertion portion 62 to be inserted into an insertion hole (8) described below on an upper side (upper base) of the trapezoidal body portion 61.

The folding portion 6A shown as a representative example is configured as a trapezoidal portion whose bottom side is one side 31 of the bottom plate 3. In addition, the insertion portion 62 is formed as a protruding piece that protrudes in a rectangular shape from the center of the upper base of the body portion 61.

As represented by the folding portion 6H in FIG. 1, the folding portions 6E, 6F, 6G, and 6H have a trapezoidal body portion 61 whose bottom side (lower base) is one of the four sides 51, 52, 53, and 54 of the top plate 5. In addition, as shown in FIG. 1, the folding portions 6E, 6F, 6G, and 6H are provided with an insertion portion 62 to be inserted into an insertion hole (8) described below on an upper side (upper base) of the trapezoidal body portion 61.

The folding portion 6H described as a representative example is configured as a trapezoidal portion whose bottom side is one side 51 of the top plate 5. In addition, the insertion portion 62 is formed as a protruding piece that protrudes in a rectangular shape from the center of the upper base of the body portion 61.

In addition, the body portions 61 of the folding portions 6A, 6B, 6C, and 6D are provided with intermediate folding lines 16 parallel to the four sides 31, 32, 33, and 34 of the bottom plate 3, respectively.

In addition, the body portions 61 of the folding portions 6E, 6F, 6G, and 6H are provided with intermediate folding lines 16 parallel to the four sides 51, 52, 53, and 54 of the top plate 5, respectively.

The intermediate folding line 16 is formed, for example, by making notches or perforations of a predetermined depth on one surface of the surface material for manufacturing the packaging material 1A.

As shown in FIG. 1, the packaging material 1A is provided with a bonding portion 7 on the first surface part 2.

The bonding portion 7 is a continuous portion that is in contact with one side 23 of the first surface part 2 parallel to the boundary line 12. In addition, the bonding portion 7 is also a portion that is bonded to a part of the second surface part 4 in a case where the first surface part 2 and the second surface part 4 are folded along the boundary line 12 in a case of performing the packaging.

The bonding portion 7 is fixed to the second surface part 4 with fixing means, such as an adhesive tape, a double-sided pressure-sensitive adhesive tape, or a pressure-sensitive adhesive, by being brought into contact with an inner portion from one side 43 that is a part of the second surface part 4 in a case of performing the packaging and that is parallel to the boundary line 12. In addition, the bonding portion 7 may be provided such that a linear insertion hole into which the bonding portion 7 is inserted is provided in a part (for example, a portion close to the one side 43) of the second surface part 4 and the bonding portion 7 is inserted into the insertion hole and fixed in a case where the packaging material 1A is folded along the boundary line 12. In this case as well, the fixing means described above may be used in addition to the fixing by the insertion, as necessary.

The bonding portion 7 in Exemplary Embodiment 1 is formed as a trapezoidal portion whose lower base is one side 23 of the first surface part 2. In addition, the bonding portion 7 is formed as a trapezoidal portion having a predetermined height.

In addition, the two sides 31 and 32 serving as the folding line of the bottom plate 3 are provided in the bonding portion 7 in a state of being extended. The existence of the folding lines extending from the bottom plate 3 facilitates the folding work of the folding portions 6A and 6H and the folding work of the folding portions 6B and 6G.

Further, the respective intermediate folding lines 16 of the folding portions 6A and 6B are provided in the folding portion 7 in a state of being extended so as to be folded at the one side 23 of the bottom plate 3 at right angles and spread upward and downward (outward) in the bonding portion 7. The existence of the extended folding lines of the intermediate folding lines facilitates the folding work at the intermediate folding lines 16 of the folding portions 6A and 6H and the folding work at the intermediate folding lines 16 of the folding portions 6B and 6G.

As shown in FIG. 1, in the packaging material 1A, the bottom plate 3 is provided with an insertion hole 8 into which a tip part of each of a total of eight folding portions 6A to 6H is inserted in a case where the folding portions 6A to 6H are folded along the intermediate folding lines 16.

As the insertion hole 8 in Exemplary Embodiment 1, four insertion holes 8*a*, 8*b*, 8*c*, and 8*d* are provided. The insertion holes 8*a*, 8*b*, 8*c*, and 8*d* are formed as rectangular holes parallel to the four sides 31, 32, 33, and 34 of the bottom plate 3 at positions shifted inwardly from the four sides by a predetermined distance.

In addition, the above-described insertion portions 62 in the folding portions 6A to 6H are inserted into the insertion holes 8*a*, 8*b*, 8*c*, and 8*d* as the respective tip parts in a case where the folding portions 6A to 6H are folded along the intermediate folding lines 16. The insertion holes 8*a*, 8*b*, 8*c*, and 8*d* are formed to have dimensions necessary for the insertion portions 62 to be inserted and secured therein.

The packaging material 1A having the above-described configuration is manufactured as one plate-like member by using a foldable surface material and performing necessary processing such as cutting processing, folding line processing, and notch processing.

The packaging material 1A can be manufactured by suppressing a portion to be discarded from the surface material as much as possible by a unique configuration such as the disposition of the bottom plate 3 and the top plate 5, and the disposition of the folding portions 6.

As the foldable surface material, in a case where it is assumed that plastics are not used, a paper surface material typified by corrugated cardboard and cardboard is used.

In addition, as the foldable surface material, a plastic surface material consisting of a plastic sheet (a sheet made of a foamed material such as polypropylene or polyethylene) or a plastic surface material made of corrugated plastic (plastic corrugated cardboard material) may be applied, as necessary.

Further, the surface material is, for example, preferably made of a single material, but may be a surface material made of a composite material or a surface material made of a material to which an ideal function is added, depending on conditions such as applications.

Use Example of Packaging Material

The packaging material 1A is used as follows in a case of packaging the object to be packaged 200A.

Figure 2A:
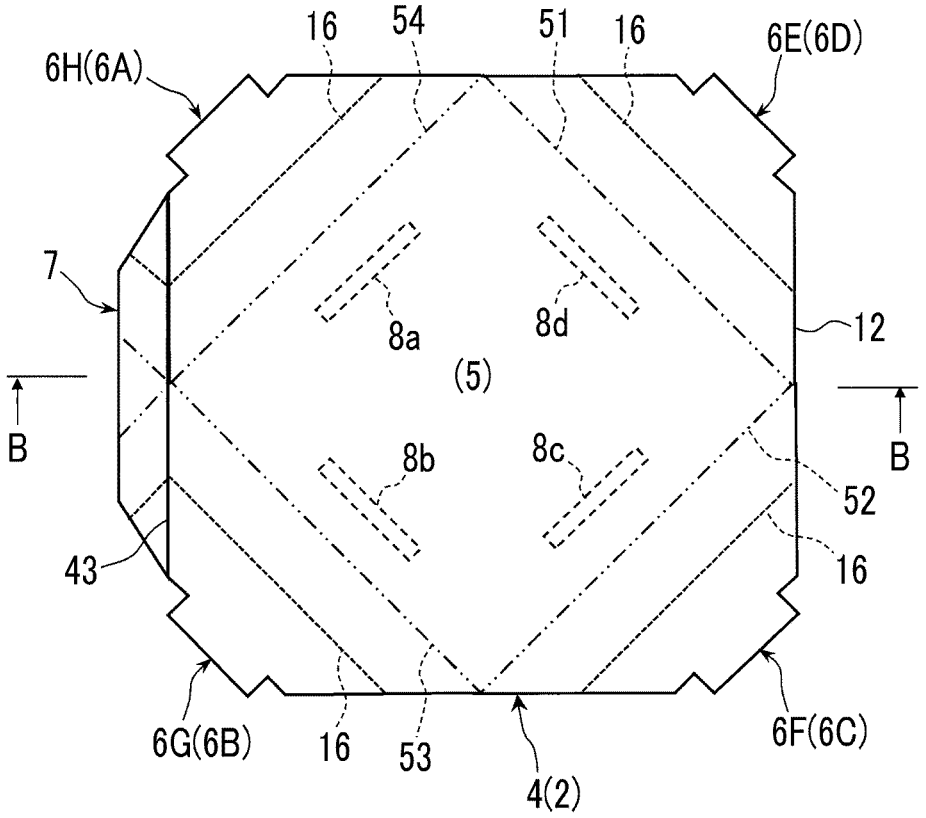
FIG. 2A is a plan view of the packaging material of FIG. 1 in a folded state.
Figure 2B:
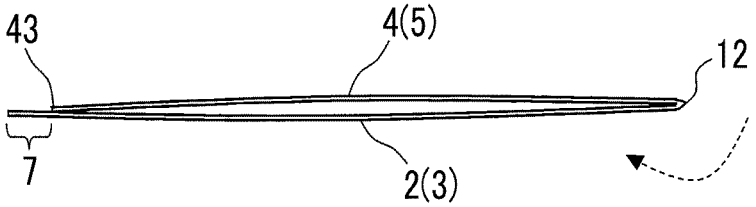
FIG. 2B is a schematic cross-sectional view taken along a line B-B of the packaging material of FIG. 2A.

First, as shown in FIGS. 2A and 2B, for example, the first surface part 2 of the packaging material 1A is folded along the boundary line 12 to face the second surface part 4.

Figure 3A:
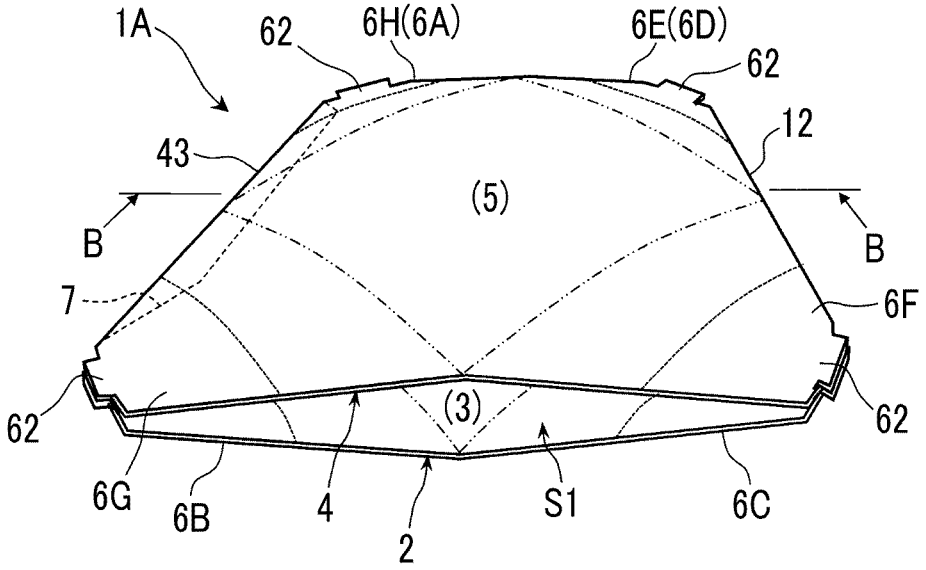
FIG. 3A is a schematic perspective view showing a state in which an accommodation space is formed in the packaging material of FIGS. 2A and 2B.
Figure 3B:
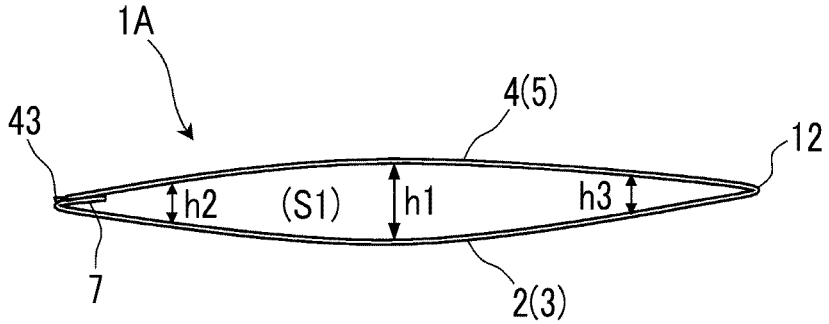
FIG. 3B is a schematic cross-sectional view taken along a line B-B of the packaging material of FIG. 3A.

As a result, the bottom plate 3 of the first surface part 2 and the top plate 5 of the second surface part 4 are in a state of facing each other as shown in FIGS. 3A and 3B and the like.

In addition, the folding portions 6E, 6F, 6G, and 6H in the second surface part 4 are in a state of facing the folding portions 6D, 6C, 6B, and 6A in the first surface part 2, respectively.

In this case, in the packaging material 1A, the bonding portion 7 is in a state of protruding below the one side 43 of the second surface part 4. As shown in FIGS. 3A and 3B, the bonding portion 7 is, for example, brought into contact with an inner surface portion from the one side 43 of the second surface part 4 and is fixed to the surface portion with fixing means such as an adhesive tape.

As a result, the packaging material 1A is in a state where the first surface part 2 and the second surface part 4 are connected to each other via the bonding portion 7.

Subsequently, as shown in FIGS. 3A and 3B, in the packaging material 1A, the first surface part 2 and the second surface part 4 are separated from each other within a possible range to form an accommodation space S1 therebetween.

The accommodation space S1 in this case is a space for accommodating the object to be packaged 200A.

In addition, the accommodation space S1 is a space having a shape in which front and rear sides thereof are open while upper and lower sides thereof are largely surrounded by the bottom plate 3 of the first surface part 2 and the top plate 5 of the second surface part 4. An opening portion of the accommodation space S1 in the packaging material 1A is a front opening portion between the one side 22 of the first surface part 2 and the one side 42 of the second surface part 4 and a rear opening portion between the one side 21 of the first surface part 2 and the one side 41 of the second surface part 4.

Further, as shown in FIG. 3B, a height hl of a central portion of the accommodation space S1 and the opening portion in the packaging material 1A is the largest (highest) dimension, and heights h2 and h3 of both side portions are dimensions smaller (lower) than the height h1 of the central portion. In addition, front and rear and right and left dimensions of the accommodation space S1 are substantially the same as dimensions of diagonals of the bottom plate 3 and the top plate 5.

Next, in the packaging material 1A, as shown in FIG. 4A, the object to be packaged 200A is accommodated in the accommodation space S1.

The object to be packaged 200A in this case is in a state where a lower surface portion 202 and an upper surface portion 201 thereof are interposed between the bottom plate 3 of the first surface part 2 and the top plate 5 of the second surface part 4, as shown in FIG. 4A.

Here, a size and a shape of the object to be packaged 200A to be packaged by the packaging material 1A satisfy two conditions in which the object to be packaged 200A can be accommodated by being put from the opening of the accommodation space S1 and a plane area of the object to be packaged 200A is smaller than an area of each of the bottom plate 3 and the top plate 5. The object to be packaged 200A in Exemplary Embodiment 1 has a disk shape having a relatively thin thickness (vertical dimension) Ta.

The packaged object 200A may be accommodated in the accommodation space S1 by expanding a space between the first surface part 2 and the second surface part 4 in an up-down direction even in a case where the thickness Ta of the object to be packaged 200A is a dimension larger than the height h1 or the like of the central portion.

In addition, in the packaging material 1A in this case, after the object to be packaged 200A is accommodated in the accommodation space S1, portions outside the object to be packaged 200A are squashed to be close to each other as shown in FIG. 4B. The portions of the packaging material 1A, which are located outside the object to be packaged 200A, are largely the folding portions 6A to 6H.

In such a state, in the packaging material 1A, the following folding work of the folding portions 6A to 6H is facilitated.

Figure 5A:
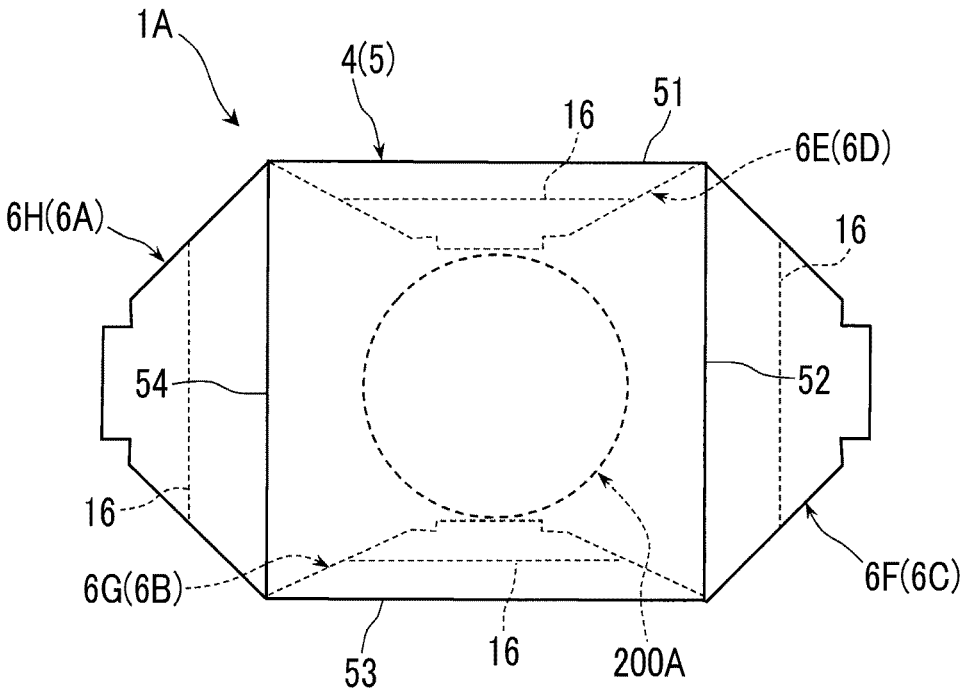
FIG. 5A is a plan view showing a state in which a part of folding portions of the packaging material of FIGS. 4A and 4B is folded.
Figure 5B:
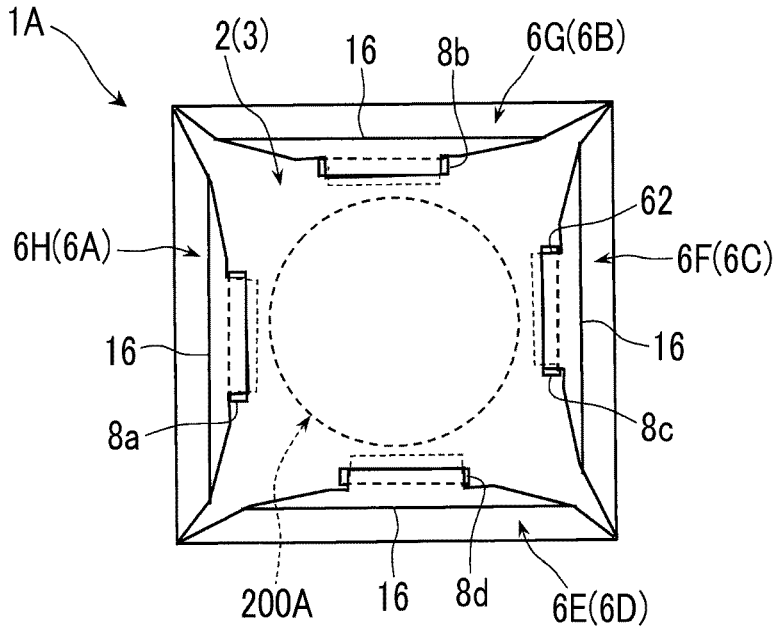
FIG. 5B is a back view showing a state in which all the folding portions of the packaging material of FIG. 5A are folded.

Subsequently, the packaging material 1A is folded at the folding portions 6A to 6H as shown in FIGS. 5A and 5B.

Figure 6A:
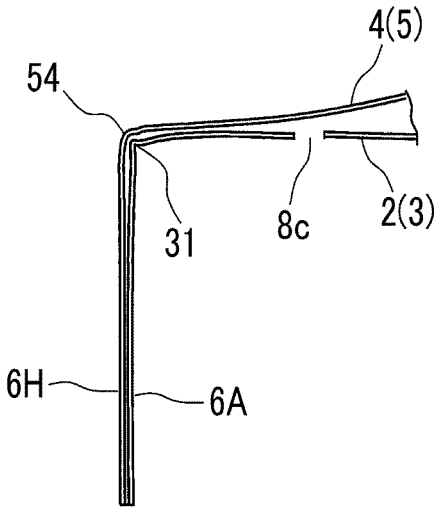
FIG. 6A is a cross-sectional schematic view showing a state in which a folding portion of the packaging material is once folded.

The folding in this case is performed by first folding the folding portions 6 toward the bottom plate 3 with each one side of the bottom plate 3 and the top plate 5 as folding lines, in a state where the folding portions 6 that are in a facing state overlap each other, as shown in FIGS. 5A and 6A. The folding portions 6 that are in a facing state are formed into the following four sets.

Specifically, as shown in FIG. 6A, a first set of the folding portion 6H and the folding portion 6A is folded toward the bottom plate 3 with the one side 54 of the top plate 5 and the one side 31 of the bottom plate 3 as folding lines.

In addition, a second set of the folding portion 6G and the folding portion 6B is folded with the one side 53 of the top plate 5 and the one side 32 of the bottom plate 3 as folding lines. A third set of the folding portion 6F and the folding portion 6C is folded with the one side 52 of the top plate 5 and the one side 33 of the bottom plate 3 as folding lines. A fourth set of the folding portion 6E and the folding portion 6D is folded with the one side 51 of the top plate 5 and the one side 34 of the bottom plate 3 as folding lines.

In FIG. 5A, a state where the folding of the folding portion 6E and the folding portion 6D and the folding of the folding portion 6G and the folding portion 6B are performed is shown as a representative example.

Figure 6B:
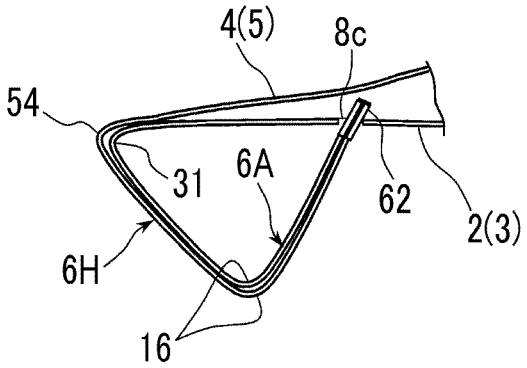
FIG. 6B is a schematic cross-sectional view showing a state in which the folding portion of FIG. 6A is bent along an intermediate folding line and then inserted into an insertion hole.

In addition, in the folding in this case, as shown in FIG. 6B, the four sets of facing folding portions 6 that are folded with each one side of the bottom plate 3 and the top plate 5 as the folding lines are folded to return to the bottom plate 3 side along the intermediate folding lines 16.

As a result, the four sets of folding portions 6 have a V-shaped folded shape.

Further, in the folding in this case, as shown in FIG. 6B, the insertion portions 62 of the four sets of facing folding portions 6 folded along the intermediate folding lines 16 are inserted into the corresponding insertion holes 8*a* to 8*d* in the bottom plate 3, and secured.

As a result, the four sets of folding portions 6 become portions that are maintained in a V-shaped folded shape. The four sets of folding portions 6 maintained in this shape become independent bottom plate support portions of the bottom plate 3, which will be described below.

FIG. 6B shows a representative state in which the folding portion 6H and the folding portion 6A are folded along the intermediate folding line 16 and then the insertion portion 62 is inserted into the insertion hole 8*c* and secured.

In addition, FIG. 5B shows a state where the folding of the four sets of facing folding portions 6 and the insertion of the respective insertion portions 62 into the insertion holes 8*a* to 8*d* are performed.

As described above, the packaging material 1A can package the object to be packaged 200A as shown in FIGS. 7A and 7B.

In the packaging material 1A, as described above, the four sets of folding portions 6 facing each other in a case of performing the packaging are folded toward the bottom plate 3 at each one side of the top plate 5 and the bottom plate 3.

As a result, in the packaging material 1A, as shown in FIGS. 7A and 7B, the top plate 5 of the second surface part 4 and the bottom plate 3 of the first surface part 2 receive tensions Fa, Fb, Fc, and Fd such that the top plate 5 and the bottom plate 3 are stretched toward (outside of) the folded four sets of folding portions 6 facing each other. In this case, the bottom plate 3 and the top plate 5 are in a state of being expanded to be stretched and widened by receiving the tensions Fa, Fb, Fc, and Fd.

Therefore, with the packaging material 1A, the object to be packaged 200A is packaged in a state where a tension is applied by folding the folding portion 6 that is a part of the packaging material 1A.

Specifically, the object to be packaged 200A packaged with the packaging material 1A is in a state where the bottom plate 3, which is expanded by receiving the tensions Fa, Fb, Fc, and Fd, is in close contact with the lower surface portion 202. In addition, the object to be packaged 200A is in a state where the top plate 5, which is expanded by receiving the tensions Fa, Fb, Fc, and Fd, is in close contact with the upper surface portion 201 in a state of being supported by the bottom plate 3. In this state, the tensions Fa, Fb, Fc, and Fd are also applied to the object to be packaged 200A.

As a result, the object to be packaged 200A is held by being interposed so as to be pressure-bonded between the bottom plate 3 and the top plate 5 (in the accommodation space S1), and is packaged in a stable state in the packaging material 1A.

Use Example as Packing Material Combined With Box of Packaging Material

Figure 8:
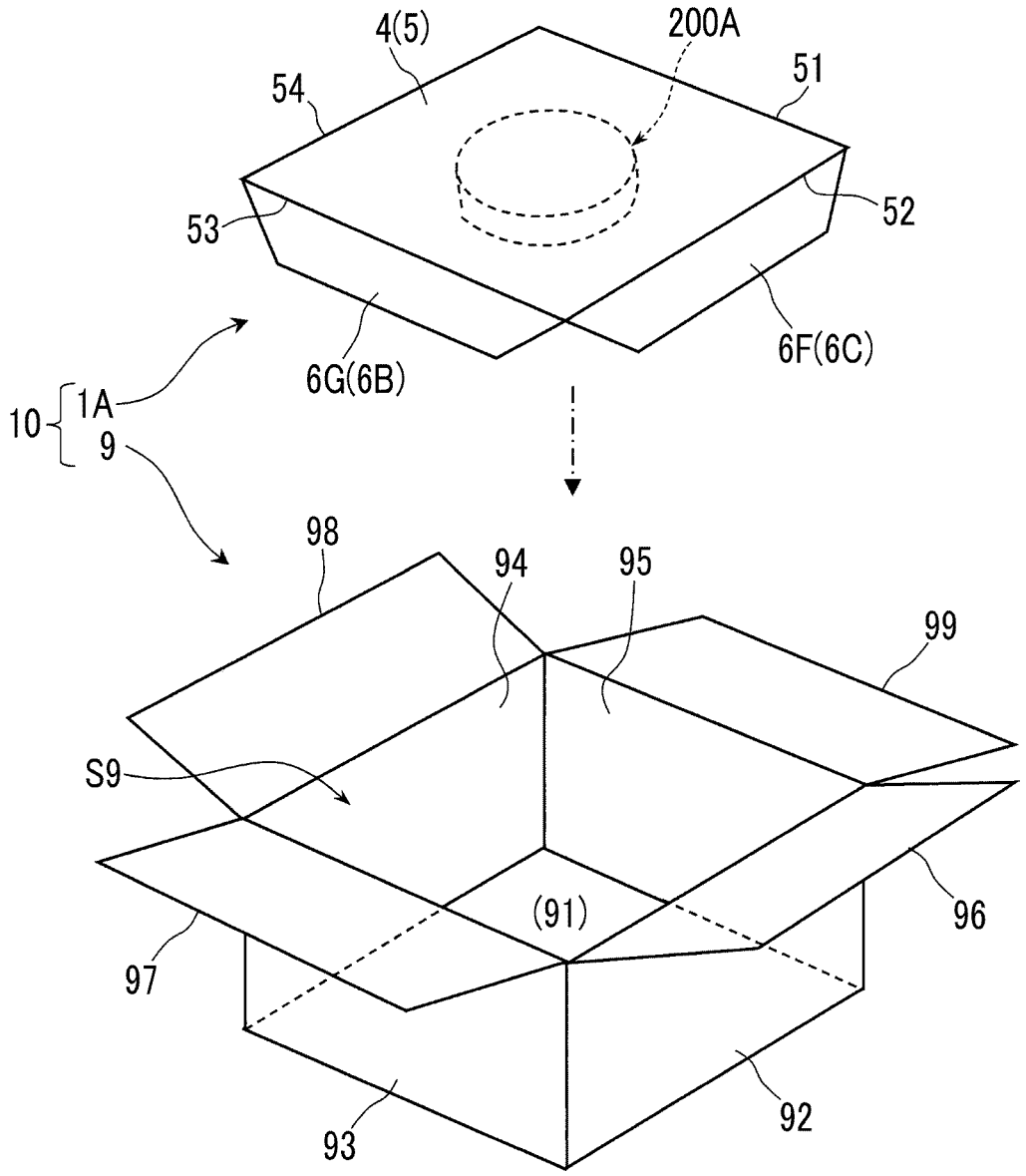
FIG. 8 is a schematic perspective view showing a packing material including the packaging material of FIG. 1 and a box.

Next, as shown in FIG. 8, the packaging material 1A can be used as the packing material 10 combined with the box 9 in which the packaging material 1A is accommodated.

First, the box 9 illustrated in FIG. 8 is a box having a rectangular bottom surface portion 91, four side surface portions 92, 93, 94, and 95, and four lid surface portions 96, 97, 98, and 99. The bottom surface portion 91 is not limited to being formed of one sheet from the beginning, and may be completed by combining surface portions divided into a plurality of sheets.

In addition, the box 9 has an accommodation space S9 surrounded by the bottom surface portion 91 and the four side surface portions 92, 93, 94, and 95. The accommodation space S9 is a space having dimensions enough to accommodate the packaging material 1A in a state where the folding portion 6 is folded. Although there is no limitation, it is preferable that the plane of the accommodation space S9 is set to such a dimension that the bottom plate 3 and the top plate 5 of the packaging material 1A are accommodated with a slight gap.

Further, the box 9 enters into a closed state by folding the four lid surface portions 96, 97, 98, and 99 at upper ends of the four side surface portions 92, 93, 94, and 95.

As such a box 9, for example, a corrugated cardboard box is used.

Figure 9A:
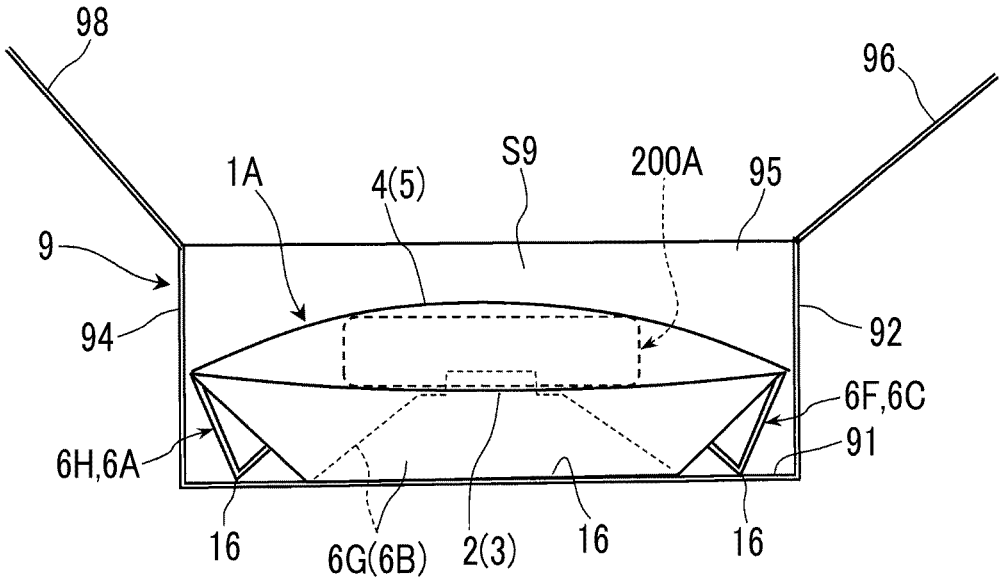
FIG. 9A is a schematic view showing a state in which the packaging material in which the object to be packaged is packaged is accommodated in the box in a partial cross section.

In the packing material 10, as shown in FIG. 9A, the packaging material 1A in which the object to be packaged 200A is packaged is accommodated in the accommodation space S9 of the box 9.

Figure 9B:
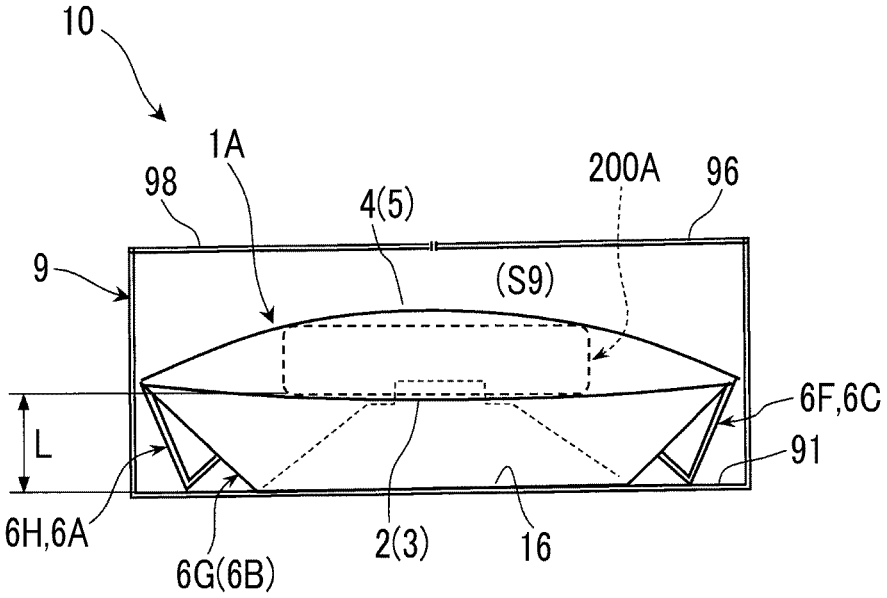
FIG. 9B is a schematic view showing a state in which the box of FIG. 9A is closed in a partial cross section.

Subsequently, in the packing material 10, as shown in FIG. 9B, the packaging material 1A is accommodated in the box 9, and then the four lid surface portions 96, 97, 98, and 99 of the box 9 are closed.

As described above, the packing material 10 is combined with the packaging material 1A to complete the packaging.

In the packaging, the packaging material 1A is in a state in which the four sets of folding portions 6 with the insertion portions 62 inserted into the insertion holes 8 after being folded as described above exist as the portions protruding downward from the bottom plate 3 and are in contact with the bottom surface portion 91 of the box 9.

The four sets of folding portions 6 are a set of the folding portions 6H and 6A, a set of the folding portions 6G and 6B, a set of the folding portions 6F and 6C, and a set of the folding portions 6E and 6D.

As described above, in the packaging material 1A, the four sets of folding portions 6 in a folded state function as the bottom plate support portions of the bottom plate 3.

Therefore, in the packing material 10, the packaging material 1A in which the object to be packaged 200A is packaged is accommodated in the accommodation space S9 of the box 9 in a state of being supported by the bottom plate support portion formed of the four sets of folding portions 6 in a folded state.

In addition, in the packing material 10, the object to be packaged 200A is accommodated in the accommodation space S9 of the box 9 in a state of floating away from the bottom surface portion 91 by the bottom plate support portion formed of the four sets of folding portions 6 by a predetermined distance L.

Therefore, with the packing material 10, the packaging material 1A in which the object to be packaged 200A is packaged is accommodated in the box 9 as it is in a state where a tension is applied by folding the folding portion 6 that is a part of the packaging material 1A.

In addition, in the packing material 10, the object to be packaged 200A is accommodated in a state of floating away from the bottom surface portion 91 of the box 9 by the packaging material 1A. As a result, the object to be packaged 200A is protected by ensuring buffering properties against an external force input from the bottom surface portion 91 of the box 9, for example.

Exemplary Embodiment 2

Figure 10:
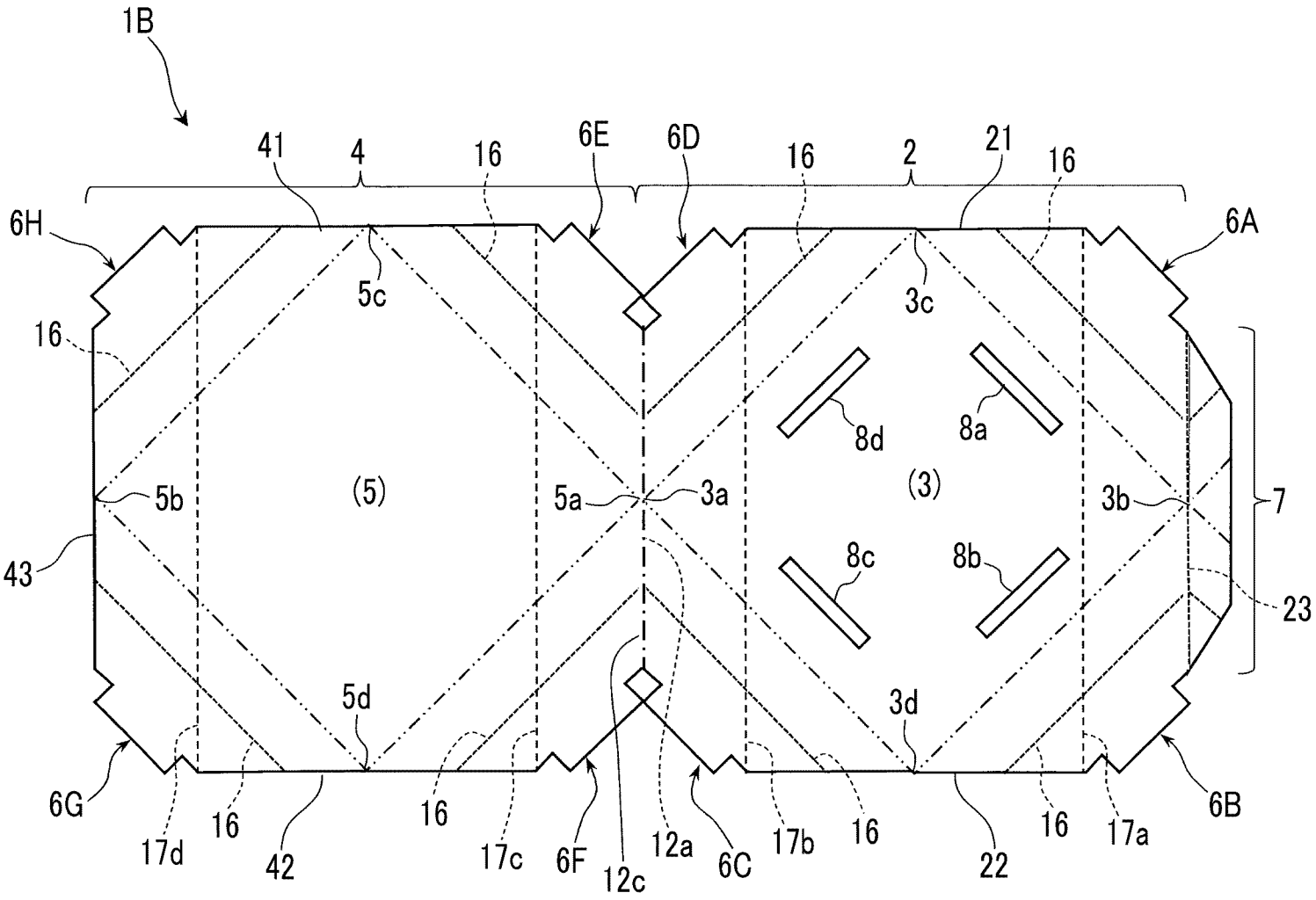
FIG. 10 is a developed view of a packaging material according to Exemplary Embodiment 2.

FIG. 10 is a developed view of a packaging material 1B according to Exemplary Embodiment 2 of the present invention.

In a case where the packaging material 1B is compared with the packaging material 1A according to Exemplary Embodiment 1, the packaging material 1B is a packaging material having the same configuration as the packaging material 1A except that a change of adding a preliminary folding line 17 to the first surface part and the second surface part is made.

Configuration of Packaging Material

The preliminary folding line 17 in the packaging material 1B is two folding lines parallel to the boundary line 12, which are provided on each of the first surface part 2 and the second surface part 4.

As shown in FIG. 10, the two preliminary folding lines 17 are provided as preliminary folding lines 17*a* and 17*b* and preliminary folding lines 17*c* and 17*d* at positions located inward by the same distance from the corners 3*a* and 5*a* and the corners 3*b* and 5*b* at the four corners of the bottom plate 3 and the top plate 5.

The packaging material 1B provided with the preliminary folding lines 17 is a packaging material appropriate for packaging an object to be packaged 200B having a relatively large thickness (vertical dimension) Tb. The thickness Tb of the object to be packaged 200B is larger than the thickness Ta of the object to be packaged 200A illustrated in Exemplary Embodiment 1. The thickness Tb is, for example, a thickness that is equal to or more than 2 times the thickness Ta of the object to be packaged 200A.

The object to be packaged 200B illustrated in Exemplary Embodiment 2 is an object having a cubic appearance shape having the thickness Tb.

Use Example of Packaging Material

The packaging material 1B is used as follows in a case of packaging the object to be packaged 200B.

First, in the packaging material 1B, as in the case of the packaging material 1A, the first surface part 2 is folded along the boundary line 12 to face the second surface part 4, and then the bonding portion 7 is fixed to an inner surface portion from the one side 43 of the second surface part 4 (see FIGS. 2A and 2B and FIGS. 3A and 3B).

As a result, the packaging material 1B is in a state where the first surface part 2 and the second surface part 4 are connected to each other via the bonding portion 7.

Figure 11A:
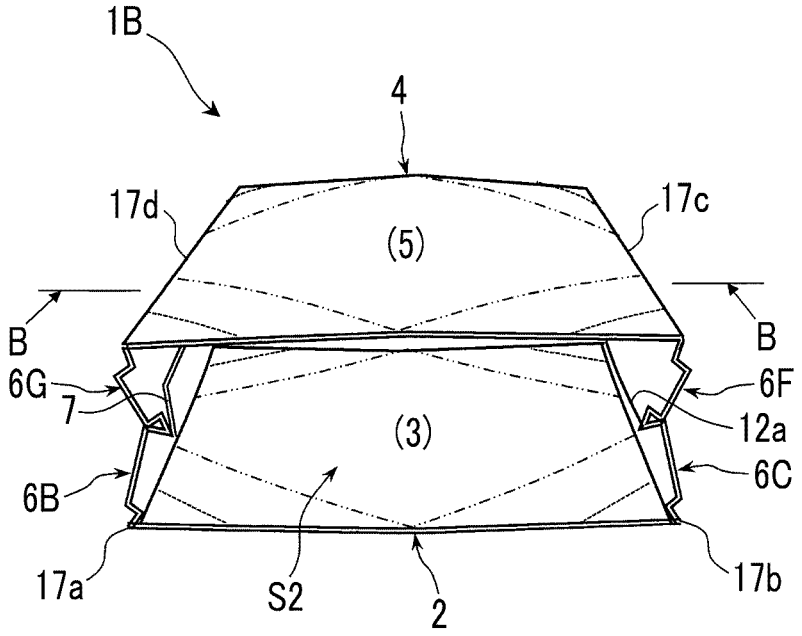
FIG. 11A is a schematic perspective view showing a state in which an accommodation space is formed in the packaging material of FIG. 10.
Figure 11B:
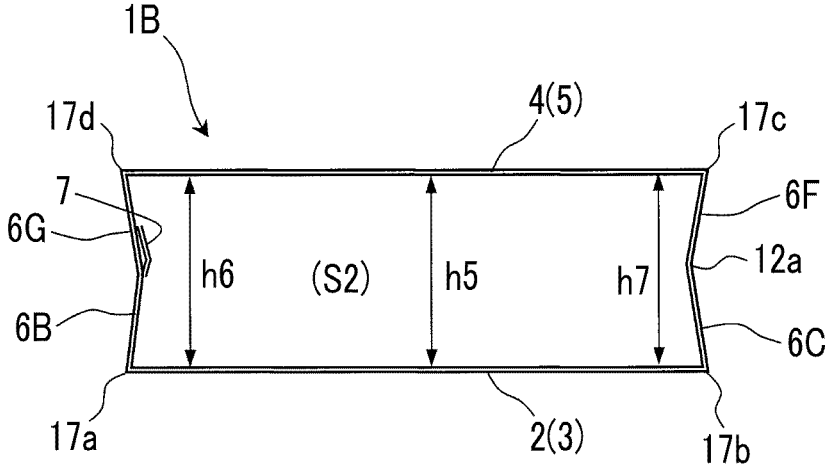
FIG. 11B is a schematic cross-sectional view taken along a line B-B of the packaging material of FIG. 11A.

Subsequently, as shown in FIGS. 11A and 11B, in the packaging material 1B, the first surface part 2 and the second surface part 4 are separated from each other within a possible range to form an accommodation space S2 therebetween.

In this case, in the packaging material 1B, as shown in FIG. 11A, a portions of the first surface part 2, which are located outside the preliminary folding lines 17*a* and 17*b*, are folded inward along the preliminary folding lines 17*a* and 17*b*, respectively. In addition, in the packaging material 1B, portions of the second surface part 4, which are located outside the preliminary folding lines 17*c* and 17*d*, are folded inward along the preliminary folding lines 17*c* and 17*d*, respectively.

As a result, in the packaging material 1B, the accommodation space S2 having a shape in which front and rear sides thereof are open while upper and lower sides thereof are surrounded by a part of the bottom plate 3 and the top plate 5 and a part of each folding portion 6 appears.

In addition, right and left sides of the accommodation space S2 are formed of remaining portions of the bottom plate 3 and the top plate 5 folded along the preliminary folding lines 17 and remaining portions of the folding portions 6 folded along the preliminary folding lines 17.

As described above, in the packaging material 1B, as shown in FIG. 11B, as the accommodation space S2, an accommodation space formed of an opening portion and an internal space having a relatively high dimension of a height h5 of a central portion and heights h6 and h7 of portions (end portions) on both right and left sides of the accommodation space is obtained.

The height h5 of the central portion and the heights h6 and h7 of the end portions of the accommodation space S2 are both dimensions higher than the height h1 (see FIG. 3B) of the central portion of the accommodation space S1 obtained with the packaging material 1A according to Exemplary Embodiment 1.

Figure 12A:
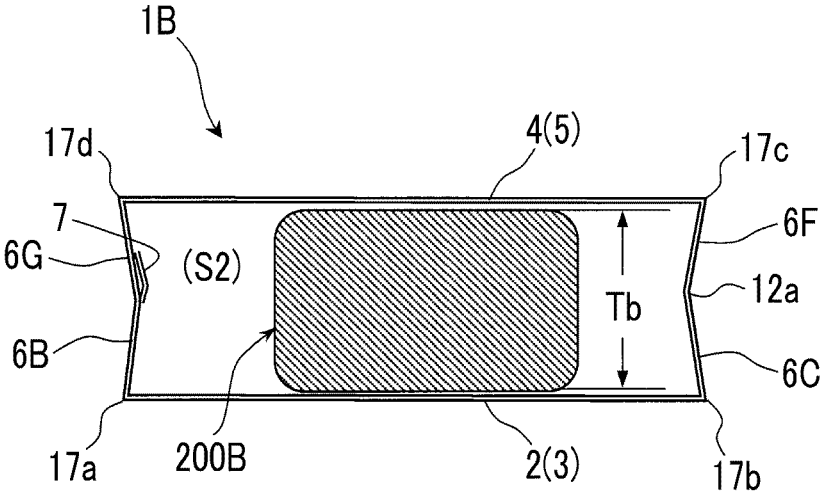
FIG. 12A is a schematic cross-sectional view of a state in which an object to be packaged is accommodated in the accommodation space of the packaging material of FIGS. 11A and 11B.

Next, in the packaging material 1B, as shown in FIG. 12A, the object to be packaged 200B is accommodated in the accommodation space S2.

In this case, by folding the packaging material 1B along the preliminary folding lines 17 as described above, the accommodation space S2 formed of an opening portion having a relatively high height is easily obtained.

Therefore, in the packaging material 1B, as shown in FIG. 12A, the object to be packaged 200B having a relatively high thickness Tb can be accommodated in the accommodation space S2.

Figure 12B:
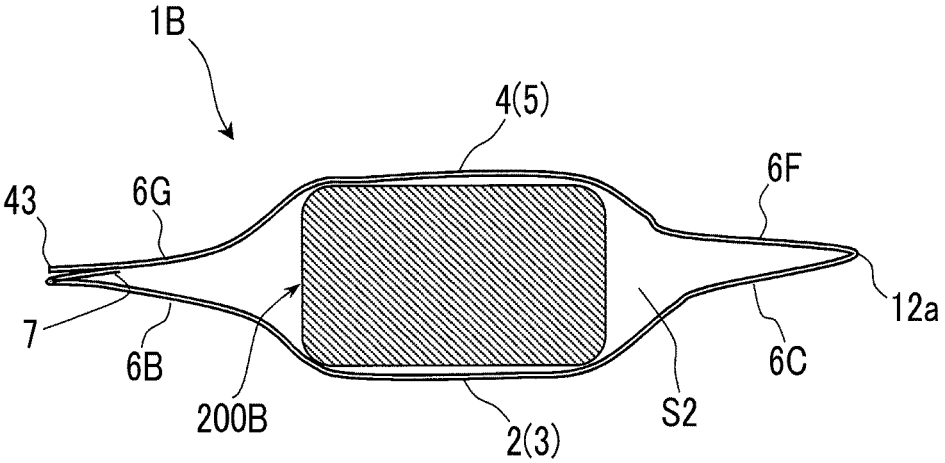
FIG. 12B is a schematic cross-sectional view of a state in which a part of the packaging material of FIG. 12A is pressed to be narrower.

In addition, also in the packaging material 1B in this case, after the object to be packaged 200B is accommodated in the accommodation space S2, portions outside the object to be packaged 200B are squashed to be close to each other as shown in FIG. 12B. The portions of the packaging material 1B, which are located outside the object to be packaged 200B, are largely the folding portions 6A to 6H.

In such a state, in the packaging material 1B as well, the following folding work of the folding portions 6A to 6H is facilitated.

Figure 13A:
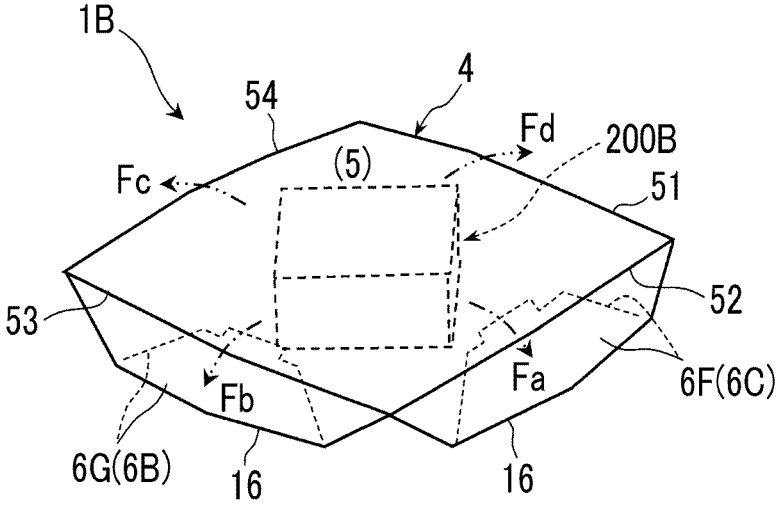
FIG. 13A is a schematic perspective view of a state in which the object to be packaged of the packaging material is packaged.
Figure 13B:
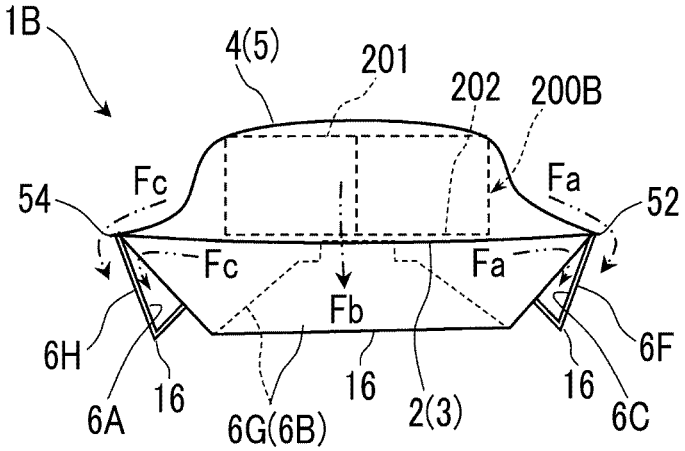
FIG. 13B is a schematic view showing a state in which the packaging material of FIG. 13A is viewed from a side.

Subsequently, in the packaging material 1B, the four sets of folding portions 6 in a facing state are folded as shown in FIGS. 13A and 13B, as in the case of the packaging material 1A according to Exemplary Embodiment 1.

In the folding in this case, the four sets of folding portions 6 in a facing state are folded toward the bottom plate 3 with each one side of the bottom plate 3 and the top plate 5 as the folding lines, and then folded to return to the bottom plate 3 side along the intermediate folding lines 16.

In addition, in the folding in this case, the insertion portions 62 of the four sets of facing folding portions 6 folded along the intermediate folding line 16 are inserted into the corresponding insertion holes 8*a* to 8*d* in the bottom plate 3, and secured.

As a result, the four sets of folding portions 6 become portions that are held in a V-shaped folded shape.

As described above, the packaging material 1B can package the object to be packaged 200B as shown in FIGS. 13A and 13B.

In the packaging material 1B, as compared with a case of packaging using the packaging material 1A in which the preliminary folding lines 17 are not provided, the object to be packaged 200B having a relatively large thickness Tb can be easily packaged as described above.

In addition, in the packaging material 1B as well, as in the case of the packaging material 1A according to Exemplary Embodiment 1, the four sets of folding portions 6 facing each other in a case of performing the packaging are folded toward the bottom plate 3 at each one side of the top plate 5 and the bottom plate 3.

As a result, in the packaging material 1B, as shown in FIGS. 13A and 13B, the top plate 5 of the second surface part 4 and the bottom plate 3 of the first surface part 2 receive tensions Fa, Fb, Fc, and Fd such that the top plate 5 and the bottom plate 3 are stretched toward (outside of) the folded four sets of folding portions 6 facing each other.

Therefore, with the packaging material 1B as well, the object to be packaged 200B is packaged in a state where a tension is applied by folding the folding portion 6 that is a part of the packaging material 1B.

Specifically, the object to be packaged 200B packaged with the packaging material 1B is in a state where the bottom plate 3, which is expanded by receiving the tensions Fa, Fb, Fc, and Fd, is in close contact with the lower surface portion 202. In addition, the object to be packaged 200B is in a state where the top plate 5, which is expanded by receiving the tensions Fa, Fb, Fc, and Fd, is in close contact with the upper surface portion 201 in a state of being supported by the bottom plate 3. In this state, the tensions Fa, Fb, Fc, and Fd are also applied to the object to be packaged 200B.

As a result, the object to be packaged 200B is held by being interposed so as to be pressure-bonded between the bottom plate 3 and the top plate 5 (in the accommodation space S2), and is packaged in a stable state in the packaging material 1B.

Use Example as Packing Material Combined With Box of Packaging Material

In addition, the packaging material 1B can also be used as the packing material 10 (see FIG. 8) combined with the box 9 that accommodates the packaging material 1B, as in the case of the packaging material 1A according to Exemplary Embodiment 1.

Even in a case of the packing material 10 including the packaging material 1B and the box 9, the packaging material 1B in which the object to be packaged 200B is packaged is accommodated in the accommodation space S9 of the box 9 (see FIG. 9A).

Therefore, with the packing material 10 as well, the packaging material 1B in which the object to be packaged 200B is packaged is accommodated in the box 9 as it is in a state where a tension is applied by folding the folding portion 6 that is a part of the packaging material 1B (see FIG. 9B).

In addition, in the packing material 10, the object to be packaged 200B is accommodated in a state of floating away from the bottom surface portion 91 of the box 9 by the packaging material 1B (see FIG. 9B).

Exemplary Embodiment 3

Figure 14:
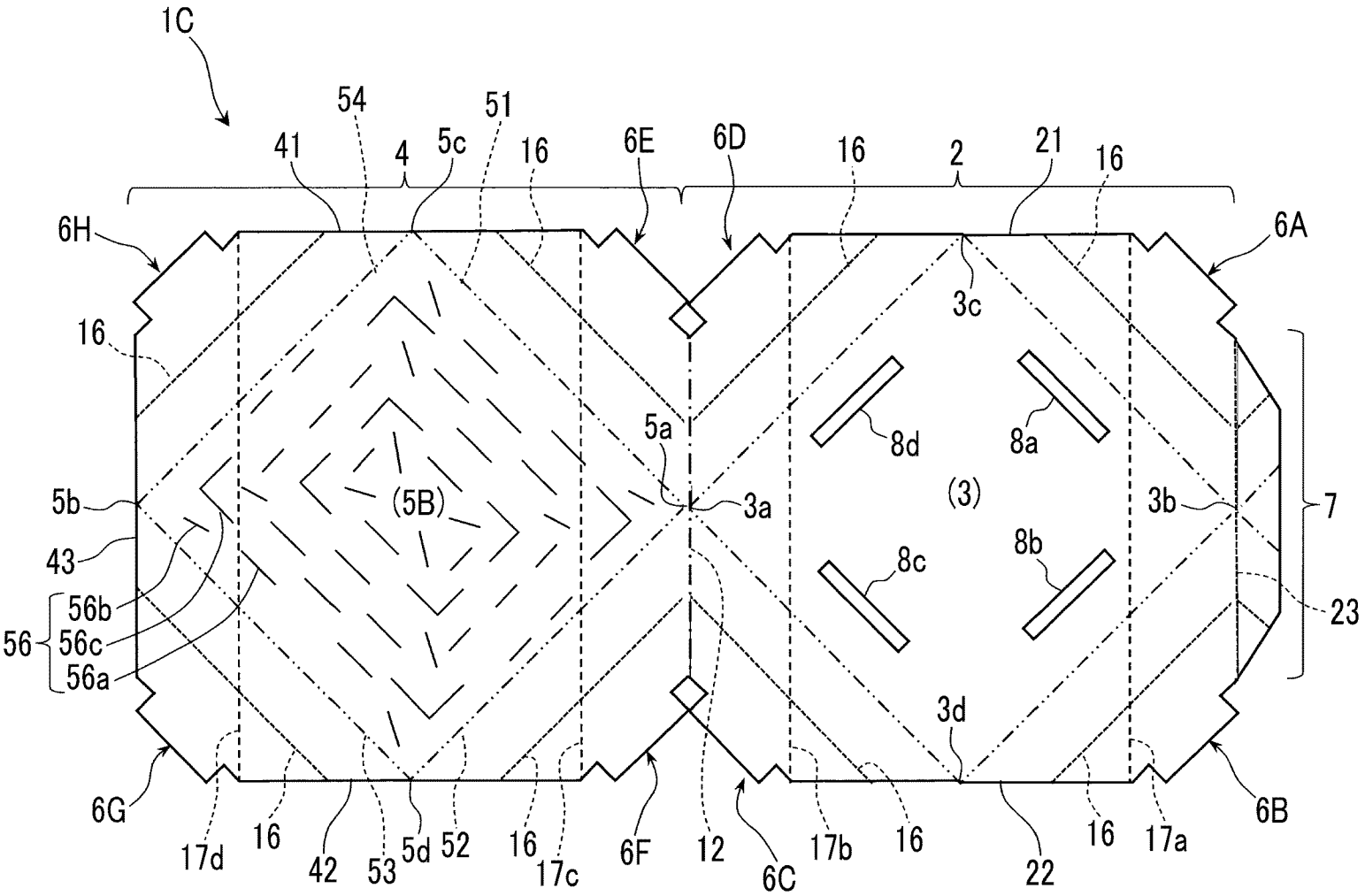
FIG. 14 is a developed view of a packaging material according to Exemplary Embodiment 3.

FIG. 14 is a developed view of a packaging material 1C according to Exemplary Embodiment 3 of the present invention.

In a case where the packaging material 1C is compared with the packaging material 1B (see FIG. 10) according to Exemplary Embodiment 2, the packaging material 1C is a packaging material having the same configuration as the packaging material 1B except that a change of adding a buffering portion 56 is made.

Configuration of Packaging Material

The buffering portion 56 in the packaging material 1C is a portion having a buffering function. The buffering portion 56 is provided on a top plate 5B of the second surface part 4. The buffering function of the buffering portion 56 is a function of, in a case where the packaging material 1C receives an impact from the outside, cushioning the impact.

The buffering portion 56 in Exemplary Embodiment 3 is formed by a plurality of notches.

The notches of the buffering portion 56 are arranged by regularly dispersing parallel line notches 56*a*, oblique line notches 56*b*, and polygonal line notches 56*c* as illustrated in FIG. 14.

The parallel line notches 56*a* are notches formed of parallel lines parallel to the sides 51 and 53 of the top plate 5B. The oblique line notches 56*b* are notches formed of oblique lines obliquely intersecting the sides 51 and 53 of the top plate 5B. The polygonal line notches 56*c* are notches formed of a polygonal line formed by perpendicularly connecting a first notch parallel to the sides 51 and 53 of the top plate 5B and a second notch parallel to the sides 52 and 54 of the top plate 5B.

The number, the dimensions, and the positions of the parallel line notches 56*a*, the oblique line notches 56*b*, and the polygonal line notches 56*c* are selected, for example, according to conditions such as a shape of an object to be packaged 200C to be packaged.

Incidentally, the buffering portion 56 may be additionally provided not only on the top plate 5B but also on the bottom plate 3.

The packaging material 1C in which the buffering portion 56 is provided on both the top plate 5B and the bottom plate 3 is beneficial in the following points. That is, in the packaging material 1C in this case, in a case of packaging a relatively large object to be packaged as the object to be packaged 200, the large object to be packaged can be packaged in a state of being more protected as compared with a case where the buffering portion 56 is provided only on one of the top plates 5B or the like.

The packaging material 1C provided with the buffering portion 56 is a packaging material appropriate for packaging the object to be packaged 200C having an upper surface portion with a composite shape. The upper surface portion of the object to be packaged 200C is a portion having a surface shape having one or more portions protruding upward, rather than a single plane.

Figure 15A:
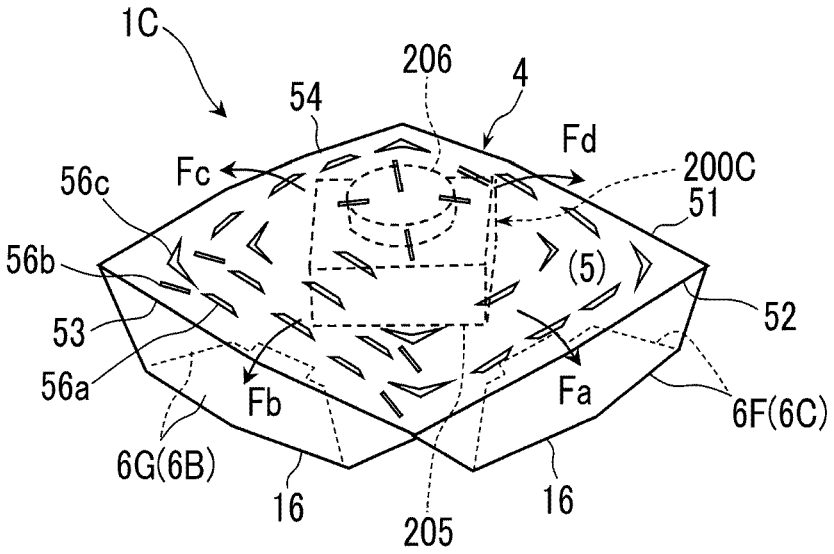
FIG. 15A is a schematic perspective view of a state in which an object to be packaged of the packaging material of FIG. 14 is packaged.
Figure 15B:
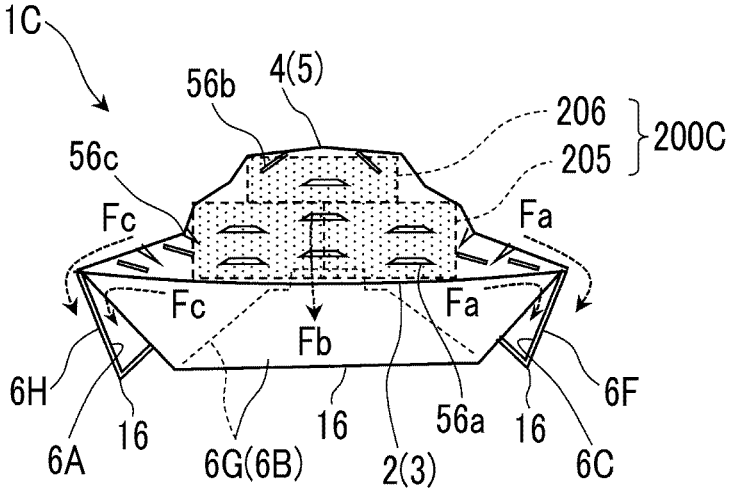
FIG. 15B is a schematic view showing a state in which the packaging material of FIG. 15A is viewed from a side.

The object to be packaged 200C illustrated in Exemplary Embodiment 3 is a structure in which the object to be packaged 200A in Exemplary Embodiment 1 is stacked on the object to be packaged 200B in Exemplary Embodiment 2, as shown in FIGS. 15A and 15B. That is, the object to be packaged 200C is a structure having an appearance shape formed by merging a lower part 205 having a cubic appearance shape and an upper part 206 having a disk-like appearance shape on an upper surface of the lower part 205.

Use Example of Packaging Material

The packaging material 1C is used as follows in a case of packaging the object to be packaged 200C.

First, in the packaging material 1C, as in the case of the packaging material 1A, the first surface part 2 is folded along the boundary line 12 to face the second surface part 4, and then the bonding portion 7 is fixed to an inner surface portion from the one side 43 of the second surface part 4 (see FIGS. 2A and 2B and FIGS. 3A and 3B).

As a result, the packaging material 1C is in a state where the first surface part 2 and the second surface part 4 are connected to each other via the bonding portion 7.

Subsequently, in the packaging material 1C, as in the case of the packaging material 1B according to Exemplary Embodiment 2, the first surface part 2 and the second surface part 4 are separated from each other within a possible range to form an accommodation space S2 therebetween (see FIGS. 11A and 11B). Thereafter, in the packaging material 1C, the object to be packaged 200C is accommodated in the accommodation space S2 (see FIGS. 12A and 12B and FIG. 15B).

Subsequently, in the packaging material 1C, as in the case of the packaging material 1B according to Exemplary Embodiment 2, the work of folding the four sets of folding portions 6 in a facing state and the work of inserting the insertion portion 62 in each of the folding portions 6 into the insertion hole 8 are performed as shown in FIGS. 15A and 15B.

In the folding in this case, as shown in FIG. 15B, the top plate 5 of the second surface part 4 comes into contact with an upper surface portion of the upper part 206 of the object to be packaged 200C and comes into contact with an upper surface portion of the lower part 205 of the object to be packaged 200C.

In this case, the top plate 5 is deformed slightly apart from the plurality of notches 56*a*, 56*b*, and 56*c* of the buffering portion 56, and comes into contact with the upper surface portion of the object to be packaged 200C while being deformed to follow the shape of the upper surface portion of the object to be packaged 200C within a possible range.

As described above, the packaging material 1C can package the object to be packaged 200C as shown in FIGS. 15A and 15B.

In the packaging material 1C, as compared with a case of the packaging using the packaging material 1A or the packaging material 1B in which the buffering portion 56 is not provided, in a case of packaging the object to be packaged 200C having the upper surface portion with a composite shape, as described above, the top plate 5 follows the shape of the upper surface portion of the object to be packaged 200C, thereby being in more contact with the upper surface portion. In addition, the object to be packaged 200C in this case is packaged in a state where a buffering function is imparted by the buffering portion 56 of the top plate 5.

In addition, in the packaging material 1C as well, as in the case of the packaging material 1A according to Exemplary Embodiment 1, the four sets of folding portions 6 facing each other in a case of performing the packaging are folded toward the bottom plate 3 at each one side of the top plate 5 and the bottom plate 3.

As a result, in the packaging material 1C as well, as shown in FIGS. 15A and 15B, the top plate 5 of the second surface part 4 and the bottom plate 3 of the first surface part 2 receive tensions Fa, Fb, Fc, and Fd such that the top plate 5 and the bottom plate 3 are stretched toward (outside of) the folded four sets of folding portions 6 facing each other.

Therefore, with the packaging material 1C as well, the object to be packaged 200C is packaged in a state where a tension is applied by folding the folding portion 6 that is a part of the packaging material 1B.

Specifically, the object to be packaged 200C packaged with the packaging material 1C is in a state where the bottom plate 3, which is expanded by receiving the tensions Fa, Fb, Fc, and Fd, is in close contact with the lower surface portion of the lower part 205. In addition, the object to be packaged 200C is in a state where the top plate 5, which is expanded by receiving the tensions Fa, Fb, Fc, and Fd, is in close contact with the upper surface portion of the upper part 206 in a state of being supported by the bottom plate 3. In this state, the tensions Fa, Fb, Fc, and Fd are also applied to the object to be packaged 200C.

As a result, the object to be packaged 200C is held by being interposed so as to be pressure-bonded between the bottom plate 3 and the top plate 5 (in the accommodation space S2), and is packaged in a stable state in the packaging material 1C.

Use Example as Packing Material Combined With Box of Packaging Material

In addition, the packaging material 1C can also be used as the packing material 10 (see FIG. 8) combined with the box 9 that accommodates the packaging material 1C, as in the case of the packaging material 1A according to Exemplary Embodiment 1.

Even in a case of the packing material 10 including the packaging material 1C and the box 9, the packaging material 1C in which the object to be packaged 200C is packaged is accommodated in the accommodation space S9 of the box 9 (see FIG. 9A).

Therefore, with the packing material 10 as well, the packaging material 1C in which the object to be packaged 200C is packaged is accommodated in the box 9 as it is in a state where a tension is applied by folding the folding portion 6 that is a part of the packaging material 1C (see FIG. 9B).

In addition, in the packing material 10, the object to be packaged 200C is accommodated in a state of floating away from the bottom surface portion 91 of the box 9 by the packaging material 1C (see FIG. 9B).

Exemplary Embodiment 4

Figure 16:
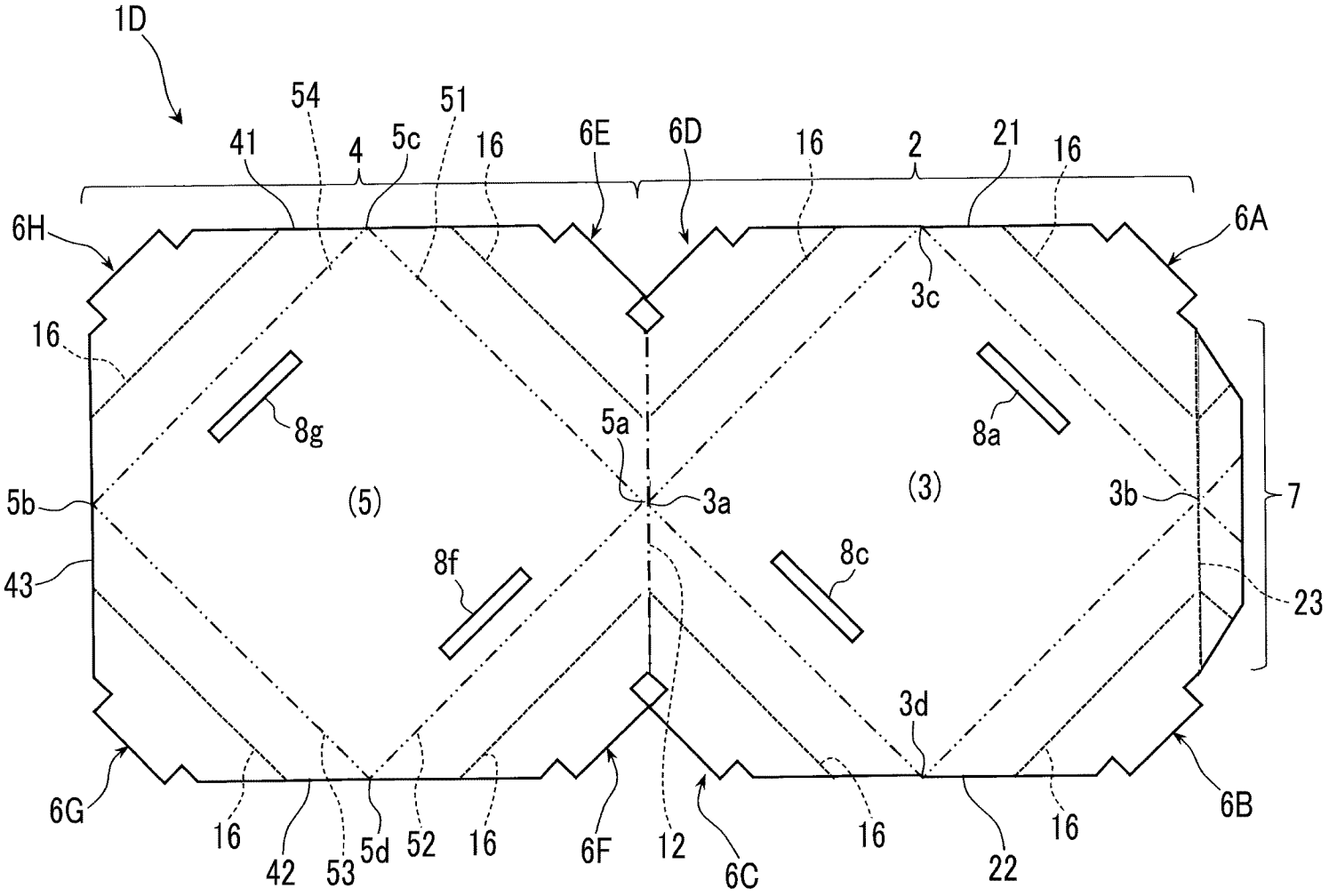
FIG. 16 is a developed view of a packaging material according to Exemplary Embodiment 4.

FIG. 16 is a developed view of a packaging material 1D according to Exemplary Embodiment 4 of the present invention.

In a case where the packaging material 1D is compared with the packaging material 1A (see FIG. 1) according to Exemplary Embodiment 1, the packaging material 1D is a packaging material having the same configuration as the packaging material 1A except that a change of the arrangement of the insertion holes 8 is made.

Configuration of Packaging Material

The insertion holes 8 in the packaging material 1D are formed of two insertion holes 8*a* and 8*c* provided in the bottom plate 3 and two insertion holes 8*f* and 8*g* provided in the top plate 5.

In a case where the insertion holes 8 are compared with the insertion holes 8 in Exemplary Embodiment 1 and the like, the insertion holes 8 can also be said to have a shape in which the insertion holes 8*b* and 8*d* (see FIG. 1 and the like) provided in the bottom plate 3 in Exemplary Embodiment 1 and the like are relocated to the top plate 5.

Use Example of Packaging Material

The packaging material 1D is used as follows in a case of packaging the object to be packaged 200A.

First, in the packaging material 1D, as in the case of the packaging material 1A, the first surface part 2 is folded along the boundary line 12 to face the second surface part 4, and then the bonding portion 7 is fixed to an inner surface portion from the one side 43 of the second surface part 4 (see FIGS. 2A and 2B and FIGS. 3A and 3B).

As a result, the packaging material 1D is in a state where the first surface part 2 and the second surface part 4 are connected to each other via the bonding portion 7.

Subsequently, in the packaging material 1D, as in the case of the packaging material 1A according to Exemplary Embodiment 1, the first surface part 2 and the second surface part 4 are separated from each other within a possible range to form an accommodation space S1 therebetween (see FIGS. 3A and 3B). Thereafter, in the packaging material 1D, the object to be packaged 200A is accommodated in the accommodation space S1 (see FIGS. 4A and 4B).

Subsequently, in the packaging material 1D, the work of folding the four sets of folding portions 6 in a facing state and the work of inserting the insertion portion 62 in each of the folding portions 6 into the insertion hole 8 are performed as shown in FIGS. 17A and 17B and FIGS. 18A and 18B.

Figure 18A:
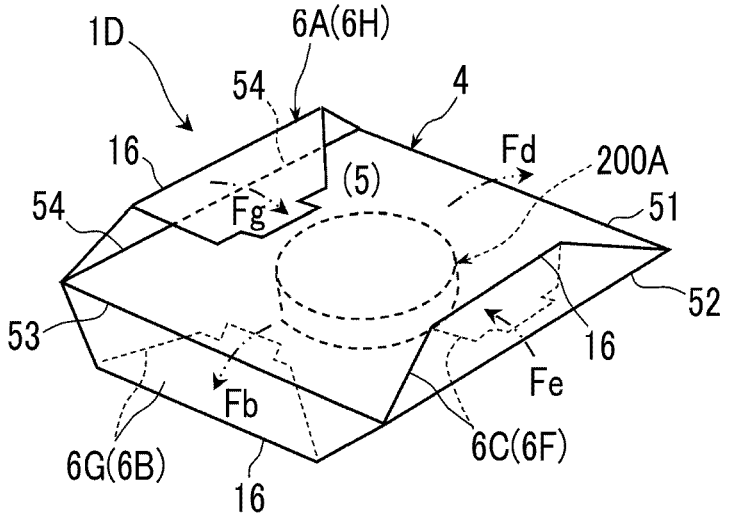
FIG. 18A is a schematic perspective view of a state in which an object to be packaged of the packaging material of FIGS. 17A and 17B is packaged.
Figure 18B:
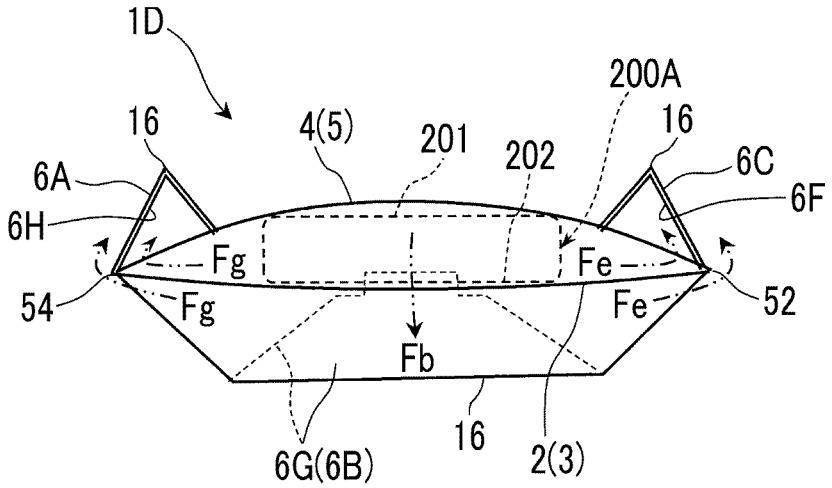
FIG. 18B is a schematic view showing a state in which the packaging material of FIG. 18A is viewed from a side.

In the folding in this case, as shown in FIGS. 18A and 18B, two sets of folding portions 6 (6E and 6D, and 6G and 6B) in a facing state are folded toward the bottom plate 3 with each one side of the bottom plate 3 and the top plate 5 as the folding lines, and then folded to return to the bottom plate 3 side along the intermediate folding lines 16.

In addition, in the folding in this case, the two remaining sets of folding portions 6 (6A and 6H, and 6C and 6F) in a facing state are folded toward the top plate 5, and then folded to return to the top plate 5 side along the intermediate folding lines 16.

Figure 17A:
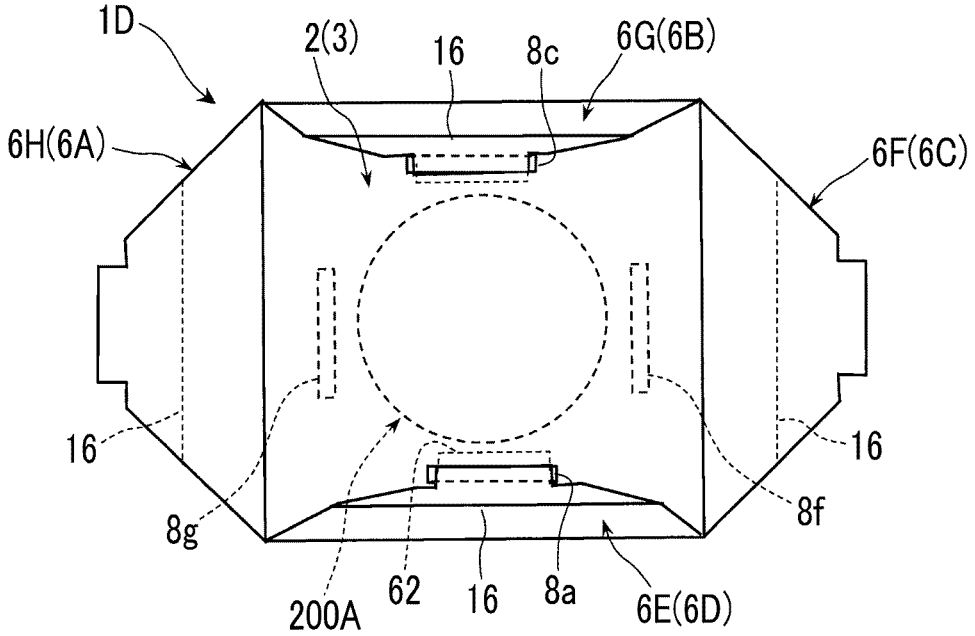
FIG. 17A is a back view showing a state in which a part of folding portions of the packaging material of FIG. 16 is folded.

Subsequently, in the folding in this case, as shown in FIG. 17A, the insertion portions 62 of the two sets of facing folding portions 6 (6G and 6B, and 6E and 6D) folded toward the bottom plate 3 along the intermediate folding lines 16 are inserted into the insertion holes 8*a* and 8*c* in the bottom plate 3, and secured.

Figure 17B:
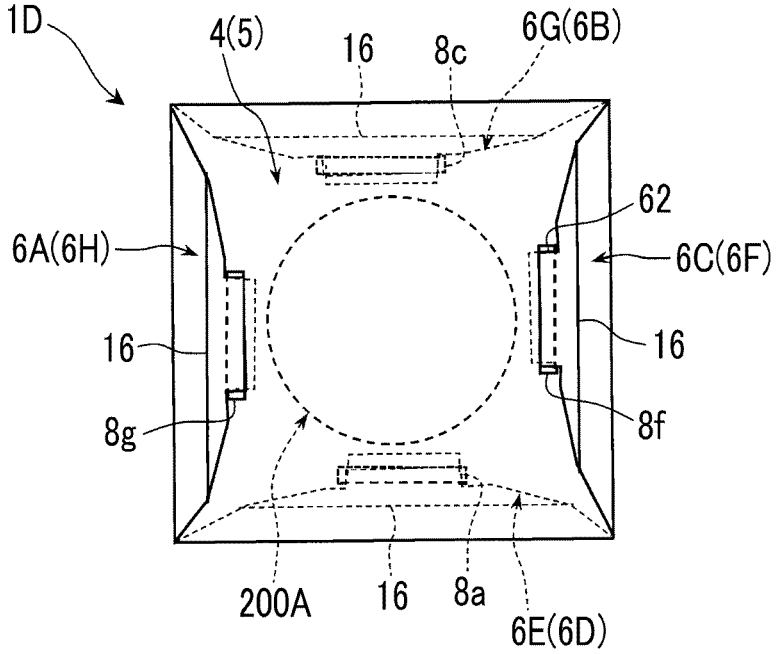
FIG. 17B is a plan view showing a state in which the remaining folding portions of the packaging material of FIG. 17A are folded.

In addition, in the folding in this case, as shown in FIG. 17B, the insertion portions 62 of the two remaining sets of facing folding portions 6 (6C and 6F, and 6A and 6H) folded toward the top plate 5 along the intermediate folding lines 16 are inserted into the corresponding insertion holes 8*f* and 8*g* in the top plate 5, and secured.

As described above, the packaging material 1D can package the object to be packaged 200A as shown in FIGS. 18A and 18B.

In the packaging material 1D, as described above, the four sets of folding portions 6 facing each other in a case of performing the packaging are folded by being divided into portions that are folded toward the bottom plate 3 and portions that are folded toward the top plate 5 at each one side of the top plate 5 and the bottom plate 3.

As a result, in the packaging material 1D, as shown in FIG. 18A and the like, the top plate 5 of the second surface part 4 and the bottom plate 3 of the first surface part 2 receive tensions Fb and Fd such that the top plate 5 and the bottom plate 3 are stretched toward (outside of) the two sets of facing folding portions 6 folded toward the bottom plate 3. In this case, the bottom plate 3 and the top plate 5 are in a state of being expanded to be stretched and widened by receiving the tensions Fb and Fd.

In addition, in the packaging material 1D, as shown in FIG. 18A and the like, the top plate 5 of the second surface part 4 and the bottom plate 3 of the first surface part 2 receive tensions Fe and Fg such that the top plate 5 and the bottom plate 3 are stretched toward (outside of) the two remaining sets of facing folding portions 6 folded toward the top plate 5. In this case, the bottom plate 3 and the top plate 5 are in a state of being expanded to be stretched and widened by receiving the tensions Fe and Fg.

Therefore, with the packaging material 1D, the object to be packaged 200A is packaged in a state where each tension is applied by folding the folding portion 6 that is a part of the packaging material 1D toward the bottom plate 3 and the top plate 5.

Use Example as Packing Material Combined With Box of Packaging Material

In addition, the packaging material 1D can also be used as the packing material 10 (see FIG. 8) combined with the box 9 that accommodates the packaging material 1D, as in the case of the packaging material 1A according to Exemplary Embodiment 1.

Even in a case of the packing material 10 including the packaging material 1D and the box 9, the packaging material 1D in which the object to be packaged 200A is packaged is accommodated in the accommodation space S9 of the box 9 (see FIG. 9A).

Figure 19:
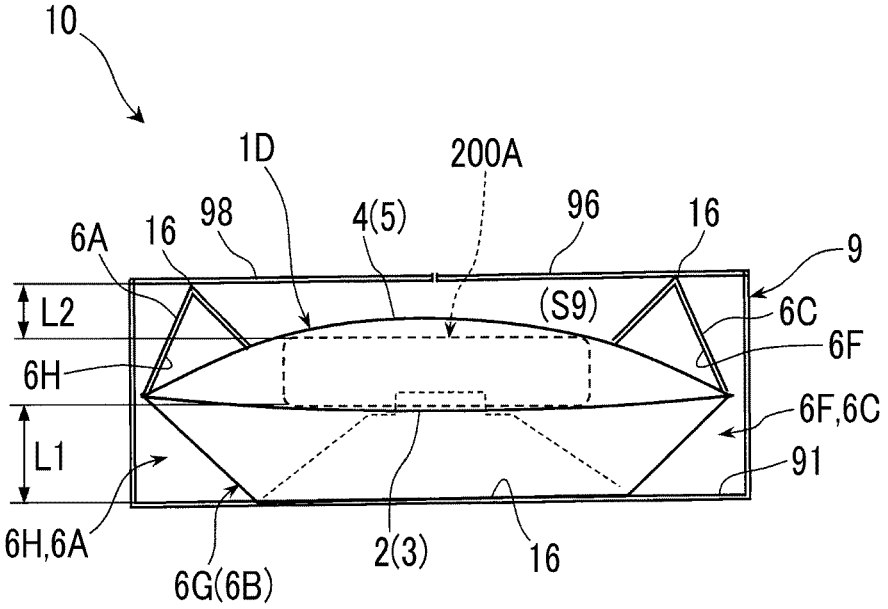
FIG. 19 is a schematic view showing a state in which the packaging material of FIGS. 18A and 18B is accommodated in the box in a partial cross section.

Therefore, with the packing material 10, as shown in FIG. 19, the packaging material 1D in which the object to be packaged 200A is packaged is accommodated in the box 9 as it is in a state where each tension is applied by folding the folding portion 6 that is a part of the packaging material 1D toward different sides.

In addition, in the packing material 10, the object to be packaged 200A is accommodated in a state of floating away from the bottom surface portion 91 of the box 9 by the packaging material 1D by a predetermined distance L1, and is accommodated in a state of being separated from the lid surface portions 96 and 98, which are top surfaces of the box 9, by a predetermined distance L2.

As a result, the object to be packaged 200A in this case is protected, for example, by ensuring buffering properties against an external force input from the bottom surface portion 91 side of the box 9, and is protected also by ensuring buffering properties against external forces input from the sides of the lid surface portions 96 and 98, which are the top surfaces of the box 9.

Exemplary Embodiment 5

Figure 20:
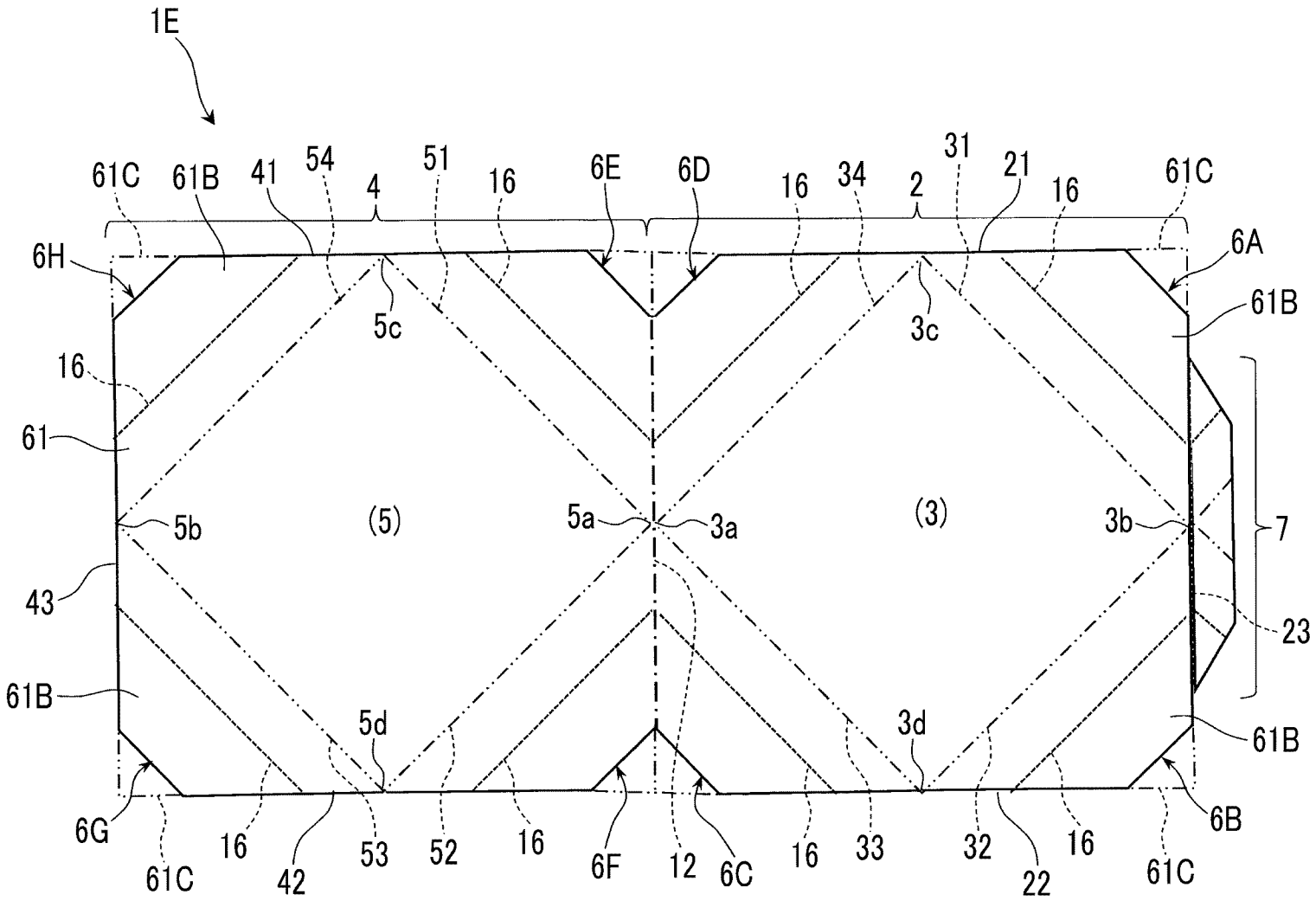
FIG. 20 is a developed view of a packaging material according to Exemplary Embodiment 5.

FIG. 20 is a developed view of a packaging material 1E according to Exemplary Embodiment 5 of the present invention.

In a case where the packaging material 1E is compared with the packaging material 1A (see FIG. 1) according to Exemplary Embodiment 1, the packaging material 1E is a packaging material having the same configuration as the packaging material 1A except that a change of the shape of the folding portion 6 and a change of omission of the insertion hole 8 are made.

Configuration of Packaging Material

As shown in FIG. 20, the folding portion 6 in the packaging material 1E is configured to include only a trapezoidal body portion 61B without being provided with the insertion portion 62 (see FIG. 1) in Exemplary Embodiment 1.

In addition, the packaging material 1E is not provided with the insertion hole 8 (see FIG. 1) in the packaging material 1A according to Exemplary Embodiment 1.

Use Example of Packaging Material

The packaging material 1E is used as a packaging material for packaging the object to be packaged 200A in the same manner as the packaging material 1A according to Exemplary Embodiment 1, except for the following differences.

Figure 21A:
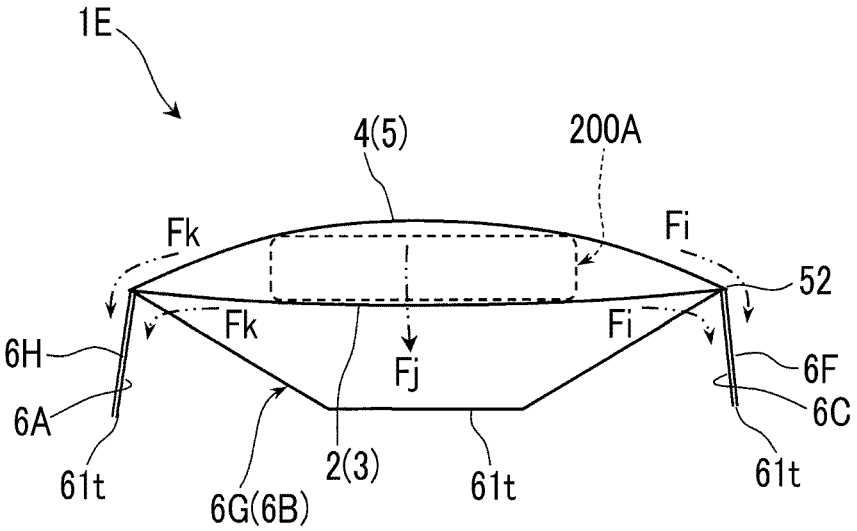
FIG. 21A is a schematic view showing a state in which an object to be packaged is packaged in the packaging material of FIG. 20.

Since the packaging material 1E does not have the insertion hole 8, the folding portions 6A to 6H are kept in a state of being folded toward the bottom plate 3 as shown in FIG. 21A.

In this case, the folding portions 6A to 6H can also enter a state of not being folded along the intermediate folding lines 16. Reference numeral 61*t* in FIG. 21A indicates a trapezoidal upper base of the folding portion 6 in a case where the folding portion 6 is not folded along the intermediate folding line 16.

The packaging material 1E can also be used to package the object to be packaged 200A as shown in FIG. 21A.

In the packaging material 1E as well, as described above, the four sets of folding portions 6 facing each other in a case of performing the packaging are folded toward the bottom plate 3 at each one side of the top plate 5 and the bottom plate 3.

As a result, in the packaging material 1E, as shown in FIGS. 21A, the top plate 5 of the second surface part 4 and the bottom plate 3 of the first surface part 2 receive tensions Fi, Fj, Fk, and Fm (Fm is not shown) such that the top plate 5 and the bottom plate 3 are stretched toward (outside of) the two sets of facing folding portions 6 folded toward the bottom plate 3.

In this case, the bottom plate 3 and the top plate 5 are in a state of being expanded to be stretched and widened by receiving each tension.

Therefore, with the packaging material 1E, the object to be packaged 200A is packaged in a state where each tension is applied by folding the folding portion 6 that is a part of the packaging material 1E toward the bottom plate 3 and the top plate 5.

Use Example as Packing Material Combined With Box of Packaging Material

In addition, the packaging material 1E can also be used as the packing material 10 (see FIG. 8) combined with the box 9 that accommodates the packaging material 1E, as in the case of the packaging material 1A according to Exemplary Embodiment 1.

Figure 21B:
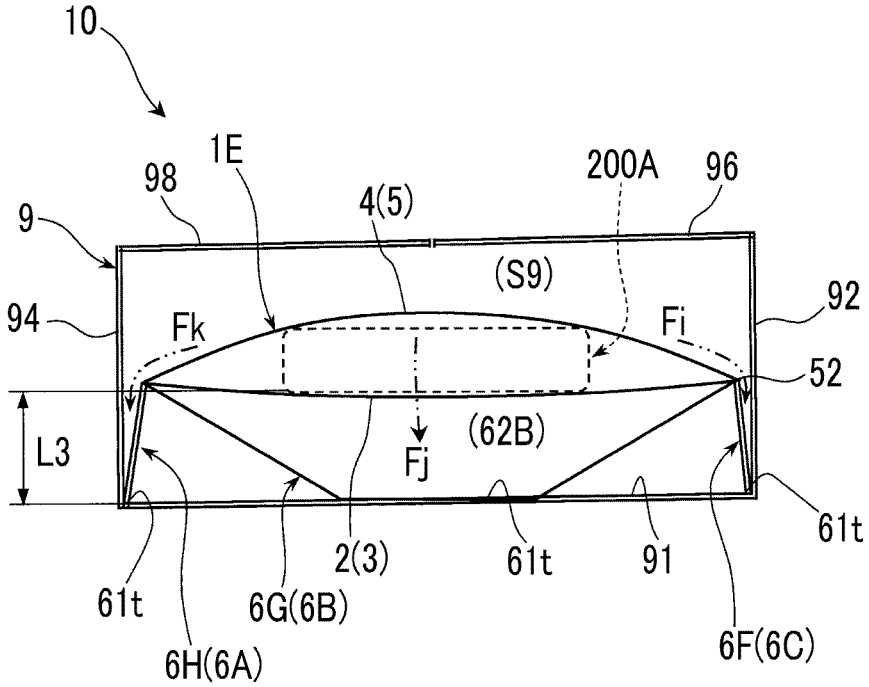
FIG. 21B is a schematic view showing a state in which the packaging material of FIG. 21A is accommodated in the box in a partial cross section.

Even in a case of the packing material 10 including the packaging material 1E and the box 9, as shown in FIG. 21B, the packaging material 1E in which the object to be packaged 200A is packaged is accommodated in the accommodation space S9 of the box 9.

In the packing material 10, as shown in FIG. 21B, for example, it is preferable that the folded folding portions 6 of the packaging material 1E are brought into contact with the side surface portions 92, 93, 94, and 95 in the accommodation space S9 of the box 9 so that the folded state is held. In this case, the box 9 may be configured, for example, such that the accommodation space S9 has a width (dimension) enough to accommodate the packaging material 1E in a state in which the folding portions 6 are folded with a slight gap from four side surface portions.

Thereby, in the packaging material 1E accommodated in the box 9, the folded folding portions 6 are brought into contact with the side surface portions in the accommodation space S9, so that the folded state is maintained. As a result, in the packaging material 1E, the top plate 5 and the bottom plate 3 in the box 9 continue to be maintained in a state of receiving the above-described tensions.

In addition, in the packing material 10 combined with the packaging material 1E, the four sets of folding portions 6 in the packaging material 1E may be folded by being divided into portions that are folded toward the bottom plate 3 and portions that are folded toward the top plate 5, as exemplified by the packaging material 1D according to Exemplary Embodiment 4.

Modification Example

The present invention is not limited to the configurations described as Exemplary Embodiments 1 to 5, and various modifications, improvements, or combinations can be made without changing the gist of each invention described in the claims. Therefore, the present invention also includes, for example, the modification example described below.

The folding portion 6 in the packaging material 1 may be formed as a folding portion formed of a body portion having a triangular shape as a whole, in which a triangular corner part is added as indicated by reference numeral 61C except for the upper base of the trapezoidal body portion 61B as shown in FIG. 20 by a two-dot chain line.

In addition, the box 9 of the packing material 10 may be provided with a hooking portion such as a notch, a recess, or a hole for hooking and holding the tip part of the folded folding portion 6 in the packaging material 1 on the four side surface portions.

In a case where the box 9 provided with the hooking portion is applied, the box 9 can accommodate the packaging material 1 in a state in which the tip part of the folded folding portion 6 in the packaging material 1 is inserted and hooked.

As a result, in the packaging material 1 accommodated in the box 9, the top plate 5 and the bottom plate 3 in the box 9 continue to be maintained in a state of receiving the above-described tensions. In addition, in this case, providing the insertion hole 8 in the packaging material 1 can also be omitted.

Supplementary Note (((1)))

A packaging material comprising:

a first surface part that is adjacent to one side of a boundary line and has a bottom plate on which an object to be packaged is placed; and a second surface part that is adjacent to the other side of the boundary line and has a top plate that holds and wraps the object to be packaged with the bottom plate in a state of being folded along the boundary line, the boundary line being interposed between the first surface part and the second surface part, wherein the bottom plate and the top plate are rectangular regions where one corner of the bottom plate and one corner of the top plate are in contact with each other at the boundary line, and portions of the first surface part and the second surface part, which are located outside four sides of a rectangular shape of the bottom plate and the top plate, are folding portions that are foldable at the four sides.

(((2)))

The packaging material according to (((1))), wherein, among four corners of the bottom plate, two corners other than the one corner are in contact with two sides of the first surface part orthogonal to the boundary line, respectively, and among four corners of the top plate, two corners, which are diagonal to each other, other than the one corner are in contact with two sides of the second surface part orthogonal to the boundary line, respectively.

(((3)))

The packaging material according to (((2))), wherein one remaining corner among the four corners of the bottom plate is in contact with one side of the first surface part parallel to the boundary line, and one remaining corner among the four corners of the top plate is in contact with one side of the second surface part parallel to the boundary line.

(((4)))

The packaging material according to any one of (((1))) to (((3))), wherein the first surface part is provided with a bonding portion that is continuous in contact with one side of the first surface part parallel to the boundary line and that is bonded to a part of the second surface part.

(((5)))

The packaging material according to any one of (((1))) to (((4))), wherein the first surface part and the second surface part are each provided with two preliminary folding lines parallel to the boundary line at positions located inward by the same distance from the one corner and one corner diagonal to the one corner among four corners of each of the bottom plate and the top plate.

(((6)))

The packaging material according to any one of (((1))) to (((5))), wherein the folding portions are configured as triangular or trapezoidal portions whose bottom sides are the four sides of the rectangular shape of the bottom plate and the top plate.

(((7)))

The packaging material according to (((6))), wherein the folding portions have intermediate folding lines parallel to the four sides of the rectangular shape of the bottom plate and the top plate, respectively.

(((8)))

The packaging material according to (((7))), wherein the bottom plate is provided with insertion holes into which tip parts of the folding portions are respectively inserted in a case where the folding portions are folded along the intermediate folding lines.

(((9)))

The packaging material according to (((7))), wherein the bottom plate and the top plate are provided with insertion holes into which tip parts of the folding portions are respectively inserted in a case where the folding portions are folded along the intermediate folding lines.

(((10)))

The packaging material according to any one of (((1))) to (((9))), wherein the top plate is provided with a buffering portion having a buffering function.

(((11)))

A packing material comprising:

the packaging material according to any one of (((1))) to (((10))); and a box in which the packaging material is accommodated.

(((12)))

The packing material according to (((11))), wherein the packaging material is accommodated in the box in a state where the folding portions are folded.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A packaging material comprising:

a first surface part that is adjacent to one side of a boundary line and has a bottom plate on which an object to be packaged is placed; and a second surface part that is adjacent to the other side of the boundary line and has a top plate that holds and wraps the object to be packaged with the bottom plate in a state of being folded along the boundary line, the boundary line being interposed between the first surface part and the second surface part, wherein the bottom plate and the top plate are rectangular regions where one corner of the bottom plate and one corner of the top plate are in direct contact with each other at the boundary line, and portions of the first surface part and the second surface part, which are located outside four respective sides of each of a rectangular shape of the bottom plate and the top plate, are folding portions that are foldable at the four respective sides of each of the bottom plate and the top plate.

2. The packaging material according to claim 1, wherein, among four corners of the bottom plate, two corners other than the one corner are in contact with two sides of the first surface part orthogonal to the boundary line, respectively, and among four corners of the top plate, two corners, which are diagonal to each other, other than the one corner are in contact with two sides of the second surface part orthogonal to the boundary line, respectively.

3. The packaging material according to claim 2, wherein one remaining corner among the four corners of the bottom plate is in contact with one side of the first surface part parallel to the boundary line, and one remaining corner among the four corners of the top plate is in contact with one side of the second surface part parallel to the boundary line.

4. The packaging material according to claim 3, wherein the first surface part is provided with a bonding portion that is continuous in contact with one side of the first surface part parallel to the boundary line and that is bonded to a part of the second surface part.

5. A packing material comprising:

the packaging material according to claim 4; and a box in which the packaging material is accommodated.

6. A packing material comprising:

the packaging material according to claim 3; and a box in which the packaging material is accommodated.

7. A packing material comprising:

the packaging material according to claim 2; and a box in which the packaging material is accommodated.

8. The packaging material according to claim 1, wherein the first surface part and the second surface part are each provided with two preliminary folding lines parallel to the boundary line at positions located inward by the same distance from the one corner and one corner diagonal to the one corner among four corners of each of the bottom plate and the top plate.

9. A packing material comprising:

the packaging material according to claim 5; and a box in which the packaging material is accommodated.

10. The packaging material according to claim 1, wherein the folding portions are configured as triangular or trapezoidal portions whose bottom sides are the four sides of the rectangular shape of the bottom plate and the top plate.

11. The packaging material according to claim 10, wherein the folding portions have intermediate folding lines parallel to the four sides of the rectangular shape of the bottom plate and the top plate, respectively.

12. The packaging material according to claim 11, wherein the bottom plate is provided with insertion holes into which tip parts of the folding portions are respectively inserted in a case where the folding portions are folded along the intermediate folding lines.

13. A packing material comprising:
the packaging material according to claim 8; and
a box in which the packaging material is accommodated.

14. The packaging material according to claim 11, wherein the bottom plate and the top plate are provided with insertion holes into which tip parts of the folding portions are respectively inserted in a case where the folding portions are folded along the intermediate folding lines.

15. A packing material comprising:
the packaging material according to claim 9; and
a box in which the packaging material is accommodated.

16. A packing material comprising:
the packaging material according to claim 7; and
a box in which the packaging material is accommodated.

17. A packing material comprising:
the packaging material according to claim 6; and
a box in which the packaging material is accommodated.

18. The packaging material according to claim 1, wherein the top plate is provided with a buffering portion having a buffering function.

19. A packing material comprising:
the packaging material according to claim 1; and
a box in which the packaging material is accommodated.

20. The packing material according to claim 19, wherein the packaging material is accommodated in the box in a state where the folding portions are folded.

* * * * *